US007806523B2

(12) United States Patent
Seino et al.

(10) Patent No.: US 7,806,523 B2
(45) Date of Patent: Oct. 5, 2010

(54) LIQUID EJECTING APPARATUS AND LIQUID CONTAINER HOLDER THEREOF

(75) Inventors: Takeo Seino, Nagano-ken (JP); Toshio Kumagai, Nagano-ken (JP); Hitotoshi Kimura, Nagano-ken (JP); Atsushi Kobayashi, Nagano-ken (JP); Taku Ishizawa, Nagano-ken (JP); Munehide Kanaya, Nagano-ken (JP); Yoshiharu Aruga, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 435 days.

(21) Appl. No.: 11/044,327

(22) Filed: Jan. 27, 2005

(65) Prior Publication Data

US 2005/0185036 A1 Aug. 25, 2005

Related U.S. Application Data

(63) Continuation-in-part of application No. 10/912,887, filed on Aug. 6, 2004, now abandoned.

(30) Foreign Application Priority Data

| | | |
|---|---|---|
| Aug. 8, 2003 | (JP) | 2003-290713 |
| Aug. 8, 2003 | (JP) | 2003-290728 |
| Aug. 29, 2003 | (JP) | 2003-306151 |
| Aug. 29, 2003 | (JP) | 2003-306513 |
| Jan. 28, 2004 | (JP) | 2004-020500 |
| Mar. 26, 2004 | (JP) | 2004-091413 |
| Mar. 31, 2004 | (JP) | 2004-106893 |

(51) Int. Cl.
*B41J 2/175* (2006.01)

(52) U.S. Cl. ..... 347/86; 347/85

(58) Field of Classification Search ..... 347/84, 347/85, 86

See application file for complete search history.

(56) References Cited

U.S. PATENT DOCUMENTS 4,467,159 A 8/1984 Ota et al.

(Continued)

FOREIGN PATENT DOCUMENTS

DE 9018060 U1 8/1990

(Continued)

OTHER PUBLICATIONS

European Search Report in Application No. 04018758.5, dated Apr. 7, 2005.

(Continued)

*Primary Examiner*—Stephen D Meier
*Assistant Examiner*—Sarah Al-Hashimi
(74) *Attorney, Agent, or Firm*—Strook & Strook & Lavan LLP

(57) ABSTRACT

A liquid ejecting apparatus of the present invention has a translationally movable member configured to be connected to a liquid container inserted in a container mounting unit, in link motion with a straight operation of the liquid container when inserting a liquid feed needle through a liquid feed port of the liquid container, translationally advance in the direction parallel with the straight operation, an apparatus side fixing structure for releasably restricting the movement of the liquid container in the mounting state in the pull-out direction, having a stopper pin to be stopped in a guide groove of a container side fixing structure formed in the liquid container, and apparatus side positioning structures installed in the translationally movable member, in cooperation with a container side positioning structure formed in the liquid container, for positioning the liquid container in a predetermined position to the translationally movable member. The liquid ejecting apparatus capable of connecting the liquid container to the translationally movable member arranged in the container mounting unit with high positioning precision is provided.

8 Claims, 31 Drawing Sheets

U.S. PATENT DOCUMENTS

| | | | | |
|---|---|---|---|---|
| 4,661,667 | A | 4/1987 | Sorimachi et al. | |
| 4,746,766 | A | 5/1988 | Soulard | |
| 5,211,431 | A | 5/1993 | Koizumi et al. | |
| 5,506,611 | A | 4/1996 | Ujita et al. | |
| 5,513,065 | A | 4/1996 | Caveney et al. | |
| 5,940,102 | A * | 8/1999 | Watanabe et al. | 347/86 |
| 5,940,959 | A | 8/1999 | Caveney et al. | |
| 6,062,667 | A | 5/2000 | Matsui et al. | |
| 6,247,805 | B1 * | 6/2001 | Iwaya | 347/86 |
| 6,286,949 | B1 | 9/2001 | Lewis et al. | |
| 6,290,343 | B1 * | 9/2001 | Lewis et al. | 347/85 |
| 6,312,084 | B1 | 11/2001 | Ujita et al. | |
| 6,502,917 | B1 | 1/2003 | Shinada et al. | |
| 6,550,902 | B2 | 4/2003 | Shinada et al. | |
| 6,554,411 | B1 * | 4/2003 | Hatasa et al. | 347/86 |
| 6,758,698 | B1 | 7/2004 | Caveney et al. | |
| 6,817,699 | B2 | 11/2004 | Hirashima et al. | |
| 6,832,830 | B2 | 12/2004 | Seino et al. | |
| 6,886,928 | B2 | 5/2005 | Sasaki et al. | |
| 7,018,027 | B2 | 3/2006 | Harada et al. | |
| 7,152,965 | B2 | 12/2006 | Ishizawa et al. | |
| 7,226,154 | B2 | 6/2007 | Seino et al. | |
| 2001/0033306 | A1 * | 10/2001 | Hatasa et al. | 347/19 |
| 2002/0071011 | A1 | 6/2002 | Hayashi et al. | |
| 2002/0167574 | A1 | 11/2002 | Shinada et al. | |
| 2002/0171700 | A1 | 11/2002 | Shinada et al. | |
| 2002/0180823 | A1 | 12/2002 | Shinada et al. | |
| 2002/0196312 | A1 * | 12/2002 | Ishizawa et al. | 347/50 |
| 2003/0058296 | A1 | 3/2003 | Shinada et al. | |
| 2003/0071874 | A1 | 4/2003 | Ishizawa et al. | |
| 2003/0085969 | A1 | 5/2003 | Shinada et al. | |
| 2003/0184622 | A1 * | 10/2003 | Sasaki et al. | 347/85 |
| 2004/0150697 | A1 * | 8/2004 | Sasaki et al. | 347/85 |
| 2005/0036015 | A1 * | 2/2005 | Seino et al. | 347/86 |
| 2005/0052511 | A1 * | 3/2005 | Seino et al. | 347/86 |
| 2005/0057622 | A1 * | 3/2005 | Kimura et al. | 347/86 |
| 2005/0068382 | A1 | 3/2005 | Kimura et al. | |
| 2005/0116998 | A1 | 6/2005 | Harada et al. | |
| 2005/0174372 | A1 * | 8/2005 | Saruta et al. | 347/7 |
| 2005/0185036 | A1 | 8/2005 | Seino et al. | |
| 2005/0248637 | A1 | 11/2005 | Seino et al. | |
| 2007/0206076 | A1 | 9/2007 | Seino et al. | |

FOREIGN PATENT DOCUMENTS

| | | | |
|---|---|---|---|
| EP | 0 940 260 | A1 | 9/1999 |
| EP | 1 375 159 | A1 | 1/2004 |
| JP | 60-133071 | U | 9/1985 |
| JP | 63-004952 | A | 1/1988 |
| JP | 63-271676 | A | 9/1988 |
| JP | 03-013628 | | 2/1991 |
| JP | 03-108557 | A | 5/1991 |
| JP | 03-197782 | A | 8/1991 |
| JP | 03-246039 | A | 11/1991 |
| JP | 04-268686 | A | 9/1992 |
| JP | 04-119078 | U | 10/1992 |
| JP | 05-004349 | | 1/1993 |
| JP | 06-023757 | U | 3/1994 |
| JP | 06-064185 | | 3/1994 |
| JP | 2504650 | | 4/1996 |
| JP | 08-169121 | A | 7/1996 |
| JP | 09-167033 | A | 6/1997 |
| JP | 10-006611 | A | 1/1998 |
| JP | 11-070663 | | 3/1999 |
| JP | 2000-198191 | A | 7/2000 |
| JP | 2001-267013 | | 9/2001 |
| JP | 2002-001980 | | 1/2002 |
| JP | 2002-019135 | A | 1/2002 |
| JP | 2002-019227 | A | 1/2002 |
| JP | 2002-031108 | | 1/2002 |
| JP | 2002-044828 | A | 2/2002 |
| JP | 2002-127546 | A | 5/2002 |
| JP | 2002-513340 | A | 5/2002 |
| JP | 2002-513341 | A | 5/2002 |
| JP | 2002-240260 | | 8/2002 |
| JP | 2003-011390 | A | 1/2003 |
| JP | 2003-019817 | | 1/2003 |
| JP | 2003-063029 | A | 3/2003 |
| JP | 2003-200590 | | 7/2003 |
| JP | 2003-341100 | A | 12/2003 |
| JP | 2004-066490 | A | 3/2004 |
| JP | 2004-074773 | A | 3/2004 |
| WO | 98/55318 | A1 | 12/1998 |
| WO | 98/55324 | A1 | 12/1998 |
| WO | WO-99/59823 | | 11/1999 |

OTHER PUBLICATIONS

U.S. Appl. No. 11/052,375, filed Feb. 7, 2005, Shinada et al., con. of U.S. Appl. No. 10/121,359.

U.S. Appl. No. 11/114,744, filed Apr. 25, 2005, Shinada et al., con. of U.S. Appl. No. 10/121,358.

* cited by examiner

LIQUID EJECTING APPARATUS AND LIQUID CONTAINER HOLDER THEREOF

CROSS-REFERENCE TO RELATED APPLICATION

This application is a continuation-in-part of copending application Ser. No. 10/912,887, filed on Aug. 6, 2004.

BACKGROUND OF THE INVENTION

1. Field of the Invention

The present invention relates to a liquid ejecting apparatus having a container mounting unit (a liquid container holder) in which a liquid container internally storing a liquid is removably mounted.

2. Description of the Related Art

As a typical example of a conventional liquid ejecting apparatus, there is an ink jet recording apparatus having an ink jet recording head for image recording. As other liquid ejecting apparatuses, for example, an apparatus having a coloring material ejecting head used to manufacture color filters such as a liquid crystal display, an apparatus having an electrode material (conductive paste) ejecting head used to form electrodes such as an organic EL display and a face emission display (FED), an apparatus having a biological organic substance ejecting head used to manufacture biological chips, and an apparatus having a sample ejecting head as a precise pipette may be cited.

The ink jet recording apparatus as a typical example of the liquid ejecting apparatus makes comparatively small noise during printing and can form small dots at high density, so that in recent years, it has been used in many printings including color printing.

As a liquid feeding method for a liquid ejecting apparatus represented by an ink jet recording apparatus, there is a method for feeding a liquid from a liquid container storing the liquid to a liquid ejecting apparatus. Furthermore, in the liquid feeding method by the liquid container, to allow a user to simply exchange the liquid container at the point of time when the liquid in the liquid container is consumed, the liquid container is generally structured as a cartridge removably mounted on the liquid ejecting apparatus.

Generally, the ink jet recording apparatus has a carriage moving back and forth along the recording face of a recording medium having a recording head for injecting ink drops and as an ink feeding method from the ink cartridge to the recording head, there is a method for feeding ink to the recording head from the ink cartridge which is mounted in the carriage and moves back and forth together with the recording head. Further, as another method, there is a method for mounting the ink cartridge in a case of the apparatus body and feeding ink to the recording head from the ink cartridge via an ink flow path formed by a flexible tube.

In either of the aforementioned ink feeding methods, it is required to mount and fix the ink cartridge easily and surely at a predetermined position of the apparatus body and furthermore, when exchanging the ink cartridge, it is required to remove the ink cartridge from the apparatus body easily and surely.

Therefore, in the conventional ink jet recording apparatus and ink cartridge, as a mechanism for surely fixing the ink cartridge at the predetermined position of the apparatus body, for example, a mechanism for inserting the ink cartridge into a cartridge holder of the apparatus body and then operating a stopper lever to press and fix the ink cartridge is used.

However, in such a cartridge fixing mechanism, the step of inserting the ink cartridge into the cartridge holder and the step of fixing the ink cartridge after insertion by operating the stopper lever are independent of each other, so that the mounting operation of the ink cartridge on the apparatus body is complicated. Further, in the conventional cartridge fixing mechanism, when removing the ink cartridge, the operations of the two steps are required.

Further, a mechanism for realizing the fixing of the ink cartridge at the time of mounting simultaneously with the insertion step may be considered. However, also in this case, when removing the ink cartridge, a step of releasing the fixing is required and the fixing release step is executed by an operation exactly different from the cartridge pull-out operation to be executed subsequently. Therefore, the cartridge removal operation is made complicated.

Therefore, to respond to the aforementioned problems, a constitution that a slider member (translationally movable member) is installed on the cartridge mounting unit of the ink jet recording apparatus, and at the time of mounting the ink cartridge, the ink cartridge is connected to the slider member, and the apparatus side fixing structure and cartridge side fixing structure are co-operated, and the movement of the ink cartridge in the pull-out direction is restricted releasably is proposed (Japanese Patent Application No. 2003-290713).

In the ink cartridge and the ink jet recording apparatus in which the ink cartridge is mounted proposed in Japanese Patent Application No. 2003-290713, the positioning accuracy of the ink cartridge to the slider member is important.

Further, among conventional ink jet recording apparatuses and ink cartridges, as indicated in WO 99/59823, there is a constitution that a storage device including a storage element (IC) for storing information such as the ink kind and residue is installed in the ink cartridge and an apparatus body side contact connected to the storage device side electrode is installed on the cartridge mounting unit of the apparatus body.

And, when mounting the ink cartridge having such a storage device in the apparatus body, at the time of mounting the ink cartridge on the apparatus body, it is necessary to surely connect the storage device side electrode to the apparatus body side contact and moreover it is necessary to surely maintain the connection state. Namely, it is necessary to suppress the displacement between the apparatus body side contact and the storage device side electrode within the conductible range. For example, it may be considered to increase the tolerance of the displacement to the apparatus body side contact by increasing the size of the storage device side electrode. However, a problem arises that in correspondence to enlargement of the storage device side electrode, the ink cartridge itself is enlarged.

The problem concerning the connection of the ink cartridge having the aforementioned storage device is important also in the ink cartridge and the ink jet recording apparatus in which the ink cartridge is mounted proposed in Japanese Patent Application No. 2003-290713 mentioned above.

Further, generally, in the ink jet recording apparatus, an ink feed needle to be inserted into the ink feed port of the ink cartridge at the time of mounting the ink cartridge is installed, and when mounting or demounting the ink cartridge, ink may leak from the ink feed needle. Ink leaking from the ink feed needle and diffused in the apparatus might soil a recording paper or short-circuit the electric wire.

As a measure for responding to the ink leakage problem, for example, in Japanese Patent Laid-Open Publication No. H5-4349, a constitution is disclosed that an absorbent material for absorbing ink leaking from an ink feed needle when mounting or demounting the ink cartridge is installed in the ink cartridge.

Further, in Japanese Patent Laid-Open Publication No. H11-70663, a constitution is disclosed that an ink absorbent material is installed in a member rotating by being pressed by an ink cartridge inserted in an apparatus, and at the time of mounting the cartridge, the ink absorbent material moves to a saving position by the rotation, and when the cartridge is not mounted, ink leaking from an ink feed needle is absorbed by the ink absorbent material.

However, in the above constitution that the ink absorbent material is installed in the ink cartridge, a problem arises that when the cartridge is not mounted, ink adhered to the ink feed needle or ink leaking from the ink feed needle cannot be absorbed.

Further, in the above constitution that the ink absorbent material which rotates by being pressed by the inserted ink cartridge and moves to the saving position is installed, a problem arises that a rotation mechanism for rotating the ink absorbent material is necessary, thus the structure of the apparatus is complicated, and a large exclusive space to reserve a rotation space of the ink absorbent material is required, thus the apparatus is enlarged.

Further, in consideration of displacing the ink absorbent material by the rotation, a constitution cannot be used that for example, a circular opening is formed in the ink absorbent material, and the ink feed needle is inserted into it, and the ink feed needle is enclosed and protected in all directions.

Furthermore, in the rotation mechanism of the ink absorbent material, at the point of time when the ink feed needle is perfectly removed from the ink feet port of the ink cartridge, the ink absorbent material does not reach yet the neighborhood of the ink flow port of the ink feed needle and there is the possibility that ink leaking from the ink flow port may not be received.

Further, even in the aforementioned ink cartridge and ink jet recording apparatus proposed in Japanese Patent Application No. 2003-290713, it is necessary to absorb ink leaking from the ink feed needle when the ink cartridge is mounted or demounted and to absorb ink leaking from the ink feed needle when the ink cartridge is not mounted.

Further, among conventional ink jet recording apparatuses and ink cartridges, as indicated in WO 99/59823, there is a constitution that a storage device including a storage element (IC) for storing information such as the ink kind and residue is installed in the ink cartridge and a recording device side contact connected to the electrode of the storage device of the ink cartridge is installed on the cartridge mounting unit of the recording apparatus.

Even in the ink cartridge and ink jet recording apparatus in which the ink cartridge is mounted proposed in Japanese Patent Application No. 2003-290713, a constitution is indicated that the recording device side contact is installed on the slider member and the electrode of the storage device of the ink cartridge is connected to the recording device side contact.

And, in the ink jet recording apparatus proposed in Japanese Patent Application No. 2003-290713, an electric cable for connecting the recording device side contact installed in the slider member to the apparatus body including a controller is required. However, when the slider member moves forward or backward, there is the possibility that the electric cable may be disconnected from the slider member side connector.

Therefore, a disconnection preventive structure for preventing such disconnection of the electric cable is required, though it is difficult from the viewpoint of design to form a disconnection preventive structure for the electric cable in the limited space (the thickness and depth directions) in the recording device. Further, it may be considered to use a cable insertion part with a disconnection preventive function provided. However, it is difficult to reserve a sufficient space for the cable connection operation around the slider member.

Furthermore, in the ink jet recording apparatus proposed in Japanese Patent Application No. 2003-290713, the electric cable displaced when the slider member moves forward or backward must be prevented from being caught by the surrounding members.

Further, in the ink jet recording apparatus proposed in Japanese Patent Application No. 2003-290713, a stopper pin of a rotation lever member constituting the apparatus side fixing structure is stopped by a stopper unit of a guide groove of the cartridge side fixing structure, thus the ink cartridge is fixed at a predetermined position.

And, the guide groove of the cartridge side fixing structure is formed so as to change the depth thereof in the longitudinal direction (extension direction), and the end of the stopper pin slides on the bottom of the guide groove, thus the part of the rotation lever member at its end displaces in the direction of the rotation axial center by its flexibility. Particularly, when taking out the ink cartridge in the mounted state by releasing the fixing thereof, the part of the rotation lever member at its end is most displaced in the direction separating from the ink cartridge in the direction of the rotation axial center.

Therefore, it is necessary to reserve a space (displacement allowable space) for allowing a displacement of the part of the rotation lever member at its end in the direction of the rotation axial center around the rotation lever member. There is a need for reserving a displacement allowable space without increasing the size (for example, thickness) of the ink jet recording apparatus.

Further, assuming a case that a user is intended to forcibly pull out the ink cartridge in the mounted state by mistake or a case that a great shock is given to the ink cartridge, in the mounted state of the ink cartridge, it is desirable to prevent the fixing of the ink cartridge in the mounted state from releasing by mistake by restricting the displacement of the part of the rotation lever member at its end in the direction of the rotation axial center (more in detail, the direction separating from the ink cartridge). On the other hand, at the time of insertion or take-out of the ink cartridge, it is necessary to ensure a smooth rotation of the rotation lever member and a smooth displacement thereof in the direction of the rotation axis.

Furthermore, assuming a case that a user unreasonably pulls out the ink cartridge in the mounted state, even in such a case, it is desirable to prevent the stopper pin of the rotation lever member from breaking.

SUMMARY OF THE INVENTION

The present invention was developed with the foregoing in view and is intended to provide a liquid ejecting apparatus capable of connecting a liquid container to a translationally movable member arranged in a container mounting unit with high positioning precision.

Further, the present invention is intended to provide a liquid ejecting apparatus capable of surely connecting an electrode of a storage device of a liquid container to a contact on the apparatus body side.

The present invention was developed with the foregoing in view and is intended to provide a liquid ejecting apparatus capable of preventing a liquid leaking when mounting and demounting a liquid container and a liquid leaking when the liquid container is not mounted from diffusion free of complication of the apparatus structure and enlargement of the apparatus.

Particularly, an object of the present invention, in a liquid ejecting apparatus in which a liquid container having a guide groove through which a stopper pin of an apparatus side fixing structure is inserted is removably mounted, is to prevent a liquid leaking when mounting and demounting the liquid container and a liquid leaking when the liquid container is not mounted from diffusion.

The present invention was developed with the foregoing in view and is intended to provide a liquid container holder capable of forming a structure for preventing an electric cable connected to a connector on the translationally movable member side from disconnection in a limited small space and a liquid ejecting apparatus having the holder.

Furthermore, the present invention is intended to provide a liquid container holder having a translationally movable member to which a liquid container having a storage means is connected, wherein a contact part of the translationally movable member can be assembled easily.

Furthermore, the present invention is intended to provide a liquid container holder capable of preventing an electric cable displaced when a translationally movable member moves forward or backward from being caught by surrounding members and a liquid ejecting apparatus having the holder.

The present invention was developed with the foregoing in view and is intended to provide a liquid container holder capable of ensuring a smooth operation of a rotation lever member without increasing the size of a liquid ejecting apparatus and the liquid ejecting apparatus having the holder.

Further, the present invention is intended to provide a liquid container holder capable of preventing the fixing of the liquid container in the mounted state from releasing by mistake and a liquid ejecting apparatus having the holder.

Furthermore, the present invention is intended to provide a liquid container holder capable of preventing a stopper pin of a rotation lever member from breaking even when the liquid container in the mounted state is unreasonably pulled out by a user and a liquid ejecting apparatus having the holder.

The present invention is a liquid ejecting apparatus having a container mounting unit in which a liquid container internally storing a liquid is to be mounted removably, comprising: a liquid feed needle configured to be inserted through a liquid feed port formed in said liquid container when said liquid container is mounted; a translationally movable member configured to be connected to said liquid container inserted in said container mounting unit and in link motion with a straight operation of said liquid container when inserting said liquid feed needle through said liquid feed port, translationally advance in a direction parallel with said straight operation; an apparatus side fixing structure configured to releasably restrict a movement of said liquid container in a mounting state in a pull-out direction, said apparatus side fixing structure having a stopper pin to be stopped in a guide groove of a container side fixing structure formed in said liquid container; and an apparatus side positioning structure installed in said translationally movable member for positioning said liquid container in a predetermined position with respect to said translationally movable member in cooperation with a container side positioning structure formed in said liquid container.

Preferably, an apparatus side contact configured to be connected to an electrode of a storage device installed in said liquid container for storing information on said liquid in said container is installed on said translationally movable member.

Preferably, said apparatus side contact is arranged near said apparatus side positioning structure.

Preferably, said stopper pin is pressed so as to press said electrode of said storage device of said liquid container in said mounting state toward said apparatus side contact.

Preferably, said apparatus side positioning structure has a positioning projection configured to be inserted in a positioning hole forming said container side positioning structure.

Preferably, said positioning hole and said container side fixing structure are arranged so that said positioning projection inserted in said positioning hole and said container side fixing structure are overlaid in a direction of thickness of said container body.

Preferably, said apparatus side positioning structure includes an apparatus side positioning face for positioning said liquid container in an insertion direction thereof and said apparatus side positioning face makes contact with a container side positioning face formed in said container side positioning structure.

Preferably, said liquid ejection apparatus is an ink jet recording apparatus, and said liquid container is an ink cartridge adapted to be removably mounted in said ink jet recording apparatus.

Preferably, said apparatus side contact is installed on a contact attachment which is formed separately from said translationally movable member and is mounted on said translationally movable member, said apparatus side contact being arranged in a position opposite to said electrode of said storage device by mounting said contact attachment on said translationally movable member.

Preferably, said contact attachment is mounted removably on said translationally movable member.

Preferably, said contact attachment has a connector conducted to said apparatus side contact.

Preferably, on a conductive part of said contact attachment, an electronic element for adjusting an electric signal is mounted.

The present invention is a liquid ejecting apparatus having a container mounting unit in which a liquid container internally storing a liquid is to be mounted removably, comprising: a liquid feed needle configured to be inserted through a liquid feed port formed in said liquid container when said liquid container is mounted; and a translationally movable member configured to be connected to said liquid container inserted in said container mounting unit and in link motion with a straight operation of said liquid container when inserting said liquid feed needle through said liquid feed port, translationally advance in a direction parallel with said straight operation, wherein in said translationally movable member, an apparatus side positioning structure for positioning said liquid container in a predetermined position with respect to said translationally movable member and an apparatus side contact configured to be connected to an electrode of a storage device installed in said liquid container for storing information on said liquid in said container are installed.

Preferably, said liquid ejecting apparatus is an ink jet recording apparatus, and said liquid container is an ink cartridge adapted to be removably mounted in said ink jet recording apparatus.

Preferably, said apparatus side contact is installed on a contact attachment which is formed separately from said translationally movable member and is mounted on said translationally movable member, said apparatus side contact being arranged in a position opposite to said electrode of said storage device by mounting said contact attachment on said translationally movable member.

Preferably, said contact attachment is mounted removably on said translationally movable member.

Preferably, said contact attachment has a connector conducted to said apparatus side contact.

Preferably, on a conductive part of said contact attachment, an electronic element for adjusting an electric signal is mounted.

The present invention is a liquid ejecting apparatus having a container mounting unit in which a liquid container internally storing a liquid is to be mounted removably, comprising: a liquid feed needle configured to be inserted through a liquid feed port formed in said liquid container when said liquid container is mounted; a translationally movable member configured to be connected to said liquid container inserted in said container mounting unit and in link motion with a straight operation of said liquid container when inserting said liquid feed needle through said liquid feed port, translationally advance in a direction parallel with said straight operation; and a liquid absorption member installed in said translationally movable member for absorbing a liquid leaking from said liquid feed needle, said liquid absorption member being positioned, when said liquid container is not mounted, near a liquid flow hole of said liquid feed needle and, when said liquid container is mounted, translationally moving integrally with said translationally movable member so as to be displaced from a position near said liquid flow hole.

Preferably, an opening through which said liquid feed needle is inserted is formed in said translationally movable member, and said liquid absorption member is installed in said opening.

Preferably, said liquid absorption member, when said liquid container is not mounted, surrounds said liquid feed needle in an area near said liquid flow hole.

Preferably, said liquid absorption member is composed of a cylindrical absorption material.

Preferably, the liquid ejecting apparatus further comprises a pressing mechanism configured to press said translationally movable member in a direction opposite to said straight operation when said liquid container is mounted, wherein said translationally movable member has an engagement part configured to be engaged with said liquid container in a mounting state.

Preferably, said engagement part, in cooperation with a container side positioning structure formed on a front of said liquid container in an insertion direction, forms an apparatus side positioning structure for positioning said liquid container in a predetermined mounting position.

Preferably, the liquid ejecting apparatus further comprises: an apparatus side fixing structure configured to releasably restrict a movement of said liquid container in a mounting state in a pull-out direction, said apparatus side fixing structure having a stopper pin to be stopped in a guide groove of a container side fixing structure formed in said liquid container.

Preferably, a storage device for storing information on said liquid internally stored is installed in said liquid container, and an apparatus side contact configured to be connected to an electrode of said storage device is installed in said translationally movable member.

Preferably, said liquid ejecting apparatus is an ink jet recording apparatus, and said liquid container is an ink cartridge adapted to be removably mounted in said ink jet recording apparatus.

The present invention is a liquid container holder in which a liquid container internally storing a liquid is mounted removably, comprising: a translationally movable member configured to be connected to said liquid container inserted in said liquid container holder and in link motion with a straight operation of said liquid container when inserting a liquid feed needle through a liquid feed port of said liquid container, translationally advance in a direction parallel with said straight operation; an apparatus side positioning structure installed in said translationally movable member for positioning said liquid container in a predetermined position with respect to said translationally movable member in cooperation with a container side positioning structure formed in said liquid container; an apparatus side contact installed in said translationally movable member and configured to be connected to an electrode of a storage device installed in said liquid container for storing information on said liquid in said container; an electric cable having a conductive end electrically connected to said apparatus side contact; a connector installed in said translationally movable member and connected to said conductive end of said electric cable; and a cable fixing part installed in said translationally movable member to which a part other than said conductive end of said electric cable is fixed.

Preferably, said cable fixing part is formed separately from said translationally movable member and then is attached to said translationally movable member.

Preferably, said cable fixing part is an extended part of a contact substrate having said apparatus side contact.

Preferably, said cable fixing part is extended in a direction of said straight operation of said liquid container when inserting said liquid feed needle through said liquid feed port.

Preferably, said electric cable and said cable fixing part are fixed by a double-coated tape.

Preferably, a ring member is fit into an overlaid part of said electric cable and said cable fixing part so that said electric cable and said cable fixing part are fixed.

Preferably, the liquid container holder further comprises an apparatus side fixing structure configured to releasably restrict a movement of said liquid container in a mounting state in a pull-out direction, said apparatus side fixing structure having a stopper pin to be stopped in a guide groove of a container side fixing structure formed in said liquid container.

Preferably, said apparatus side contact is installed on a contact attachment which is formed separately from said translationally movable member and is mounted on said translationally movable member, said apparatus side contact being arranged in a position opposite to said electrode of said storage device by mounting said contact attachment on said translationally movable member.

Preferably, said contact attachment is mounted removably on said translationally movable member.

Preferably, said contact attachment has a connector conducted to said apparatus side contact.

Preferably, on a conductive part of said contact attachment, an electronic element for adjusting an electric signal is mounted.

The present invention is a liquid ejecting apparatus comprising: the above-mentioned liquid container holder; and a liquid ejecting head for ejecting a liquid fed from said liquid container mounted in said liquid container holder.

The present invention is a liquid container holder in which a liquid container internally storing a liquid is mounted removably, comprising: pressing means for giving pressing force to said liquid container in a direction opposite to an insertion direction when said liquid container is mounted; an apparatus side fixing structure configured to releasably restrict a movement of said liquid container in a mounting state in a pull-out direction, said apparatus side fixing structure having a rotation lever member having a stopper pin to be stopped in a guide groove of a container side fixing structure formed in said liquid container; and a support member for rotatably supporting said rotation lever member, wherein said rotation lever member is structured, when releasing fixing of said liquid container in said mounting state and taking out said liquid container, so that at least a part of said rotation lever member is displaced in a direction of separating from said liquid container in a rotation axial center direction thereof by sliding of said stopper pin on a bottom of said guide groove whose depth gradually becomes shallower in a moving direction of said stopper pin, and wherein a lever saving space, into which at least a part of said rotation lever member displaced in a direction of separating from said liquid container in said rotation axial center direction enters, is formed in said support member.

Preferably, said support member has a restriction unit for, when said liquid container is in said mounting state, approaching or making contact with at least a part of said rotation lever member and restricting a displacement of at least a part of said rotation lever member in said direction of separating from said liquid container in said rotation axial center direction.

Preferably, said restriction unit, when said liquid container is in said mounting state, is close to or makes contact with a part of said rotation lever member on a rotation axial center side than a forming part of said stopper pin of said rotation lever member.

Preferably, an emergency saving space, into which at least a part of said forming part of said stopper pin of said rotation lever member displaced in said direction of separating from said liquid container in said rotation axial center direction enters when said liquid container in said mounting state is forcibly pulled out, is formed on said support member.

Preferably, said lever saving space has a saving hole formed in an area corresponding to a forming part of said stopper pin of said rotation lever member when releasing fixing of said liquid container in said mounting state and taking out said liquid container and a saving concavity formed contiguous to said saving hole on a rotation axial center side of said rotation lever member.

Preferably, the liquid container holder further comprises an additional hole formed contiguous to said saving hole in a rotational direction of said rotation lever member when inserting said liquid container into said liquid container holder.

Preferably, said pressing means has a translationally movable member configured to be connected to said liquid container inserted in said liquid container holder, in link motion with a straight operation of said liquid container when inserting said liquid feed needle through said liquid feed port, translationally advance in a direction parallel with said straight operation Preferably, the liquid container holder further comprises: an apparatus side positioning structure installed in said translationally movable member for positioning said liquid container in a predetermined position with respect to said translationally movable member in cooperation with a container side positioning structure formed in said liquid container.

Preferably, said apparatus side positioning structure has a positioning projection configured to be inserted in a positioning hole forming said container side positioning structure.

The present invention is a liquid ejecting apparatus comprising: the above-mentioned liquid container holder, and a liquid ejecting head for ejecting a liquid fed from said liquid container mounted in said liquid container holder.

The present invention is a liquid container holder on which a liquid container internally storing a liquid is mounted removably, comprising: a translationally movable member configured to be connected to said liquid container inserted in said liquid container holder and in link motion with a straight operation of said liquid container when inserting a liquid feed needle through a liquid feed port of said liquid container, translationally advance in a direction parallel with said straight operation, and an apparatus side contact installed in said translationally movable member and configured to be connected to an electrode of a storage device installed in said liquid container for storing information on said liquid in said container, wherein said apparatus side contact is installed on a contact attachment which is formed separately from said translationally movable member and is mounted on said translationally movable member, said apparatus side contact being arranged in a position opposite to said electrode of said storage device by mounting said contact attachment on said translationally movable member.

Preferably, said contact attachment is mounted removably on said translationally movable member.

Preferably, said contact attachment has a connector conducted to said apparatus side contact.

Preferably, on a conductive part of said contact attachment, an electronic element for adjusting an electric signal is mounted.

The present invention is a liquid ejecting apparatus, comprising: the above mentioned liquid container holder; and a liquid ejecting head for ejecting a liquid fed from said liquid container mounted in said liquid container holder.

According to the present invention, the liquid container can be connected to the translationally movable member arranged in the liquid container holder with high positioning precision.

Further, according to the present invention, the electrode of the storage device of the liquid container can be surely connected to the contact on the apparatus body side.

According to the present invention, a liquid leaking when mounting and demounting a liquid container and a liquid leaking when the liquid container is not mounted can be prevented from diffusion free of complication of the apparatus structure and enlargement of the apparatus.

According to the present invention, a structure for preventing the electric cable connected to the connector on the translationally movable member side from disconnection can be formed in a limited small space.

Furthermore, according to the present invention, the electric cable displaced when the translationally movable member moves forward or backward can be prevented from being caught by surrounding members.

According to the present invention, the smooth operation of the rotation lever member can be ensured without increasing the size of the liquid ejecting apparatus.

Further, according to the present invention, the fixing of the liquid container in the mounted state can be prevented from releasing by mistake.

Furthermore, according to the present invention, the stopper pin of the rotation lever member can be prevented from breaking even when the liquid container in the mounted state is unreasonably pulled out by a user.

BRIEF DESCRIPTION OF THE DRAWINGS

The foregoing and other objects, features, and advantages of the present invention will be understood from the following detailed description in connection with the accompanying drawings, in which:

FIG. 12A is a drawing showing the state that the ink cartridge is removed, and FIG. 12B is a drawing showing the state that the ink cartridge is mounted;

FIG. 15A is a drawing viewed from obliquely above, and FIG. 15B is a drawing viewed from obliquely below;

FIG. 16A is a drawing showing the rear of the front end, and FIG. 16B is a drawing showing the front;

FIG. 20A is a perspective view viewed in the forward oblique direction, and FIG. 20B is a perspective view viewed in the backward oblique direction;

FIG. 21A is a perspective view viewed in the forward oblique direction, and FIG. 21B is a perspective view viewed in the backward oblique direction;

FIG. 22A is a perspective view viewed in the forward oblique direction, and FIG. 22B is a perspective view viewed in the backward oblique direction;

DESCRIPTION OF THE PREFERRED EMBODIMENTS

The ink jet recording apparatus as an embodiment of the liquid ejecting apparatus of the present invention will be explained below with reference to the accompanying drawings.

Figure 1:
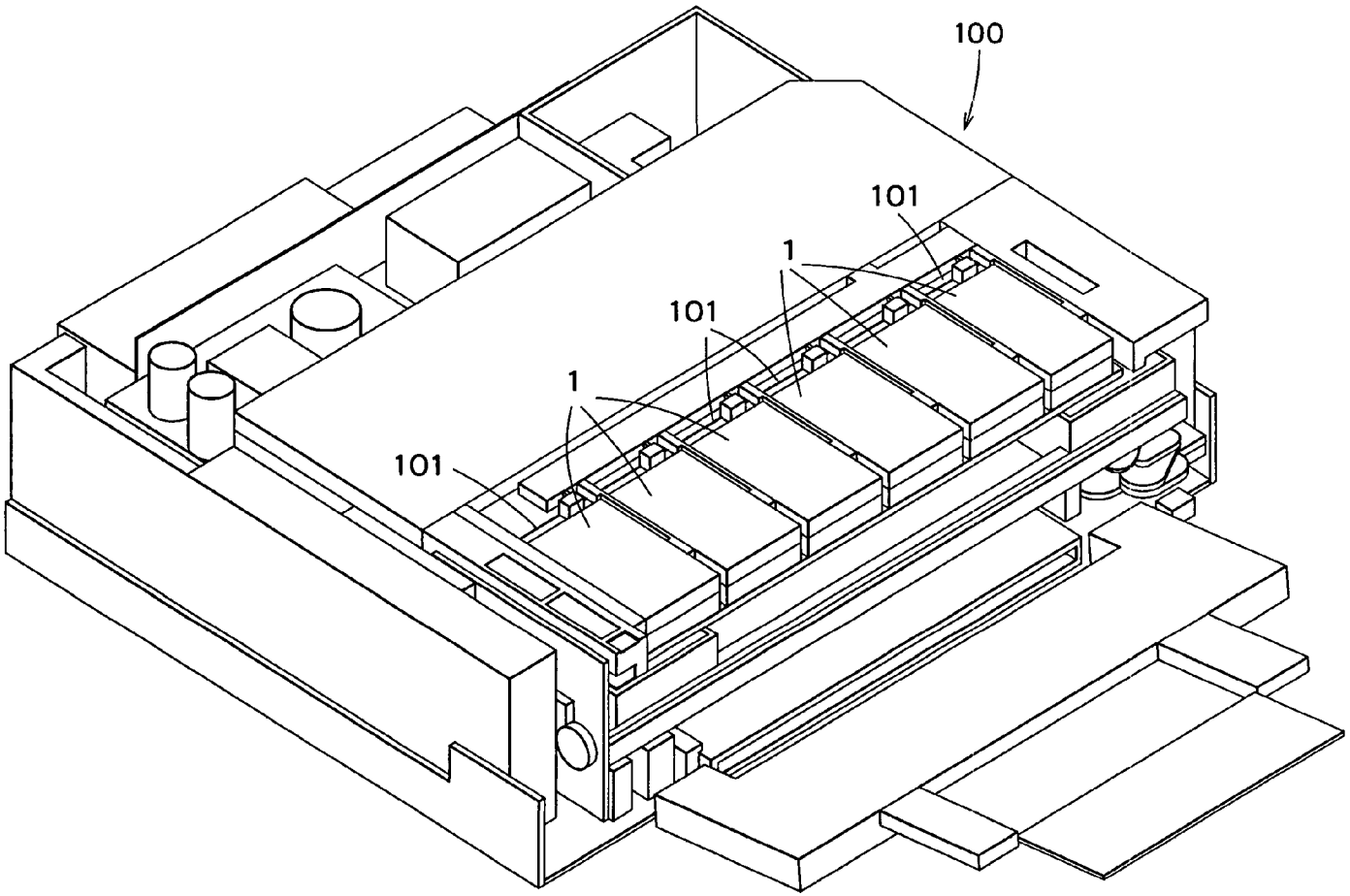
FIG. 1 is a perspective view showing the state that an ink cartridge is mounted in a cartridge mounting unit of the ink jet recording apparatus as an embodiment of the present invention.

FIG. 1 is a perspective view showing the state that ink cartridges 1 are mounted in cartridge mounting units (liquid container holders) 101 of an ink jet recording apparatus 100 of this embodiment. In this example, six cartridge mounting units 101 are installed in the ink jet recording apparatus 100 and each cartridge mounting unit 101 is opened on the front of the ink jet recording apparatus 100. Further, the six cartridge mounting units 101 are arranged side by side on the same horizontal plane and the six ink cartridges 1 are flatwise arranged side by side. Ink fed from the ink cartridges 1 is ejected in drops toward a processed article such as a recording paper from an ink jet recording head (a liquid ejecting head) 200.

Figure 2:
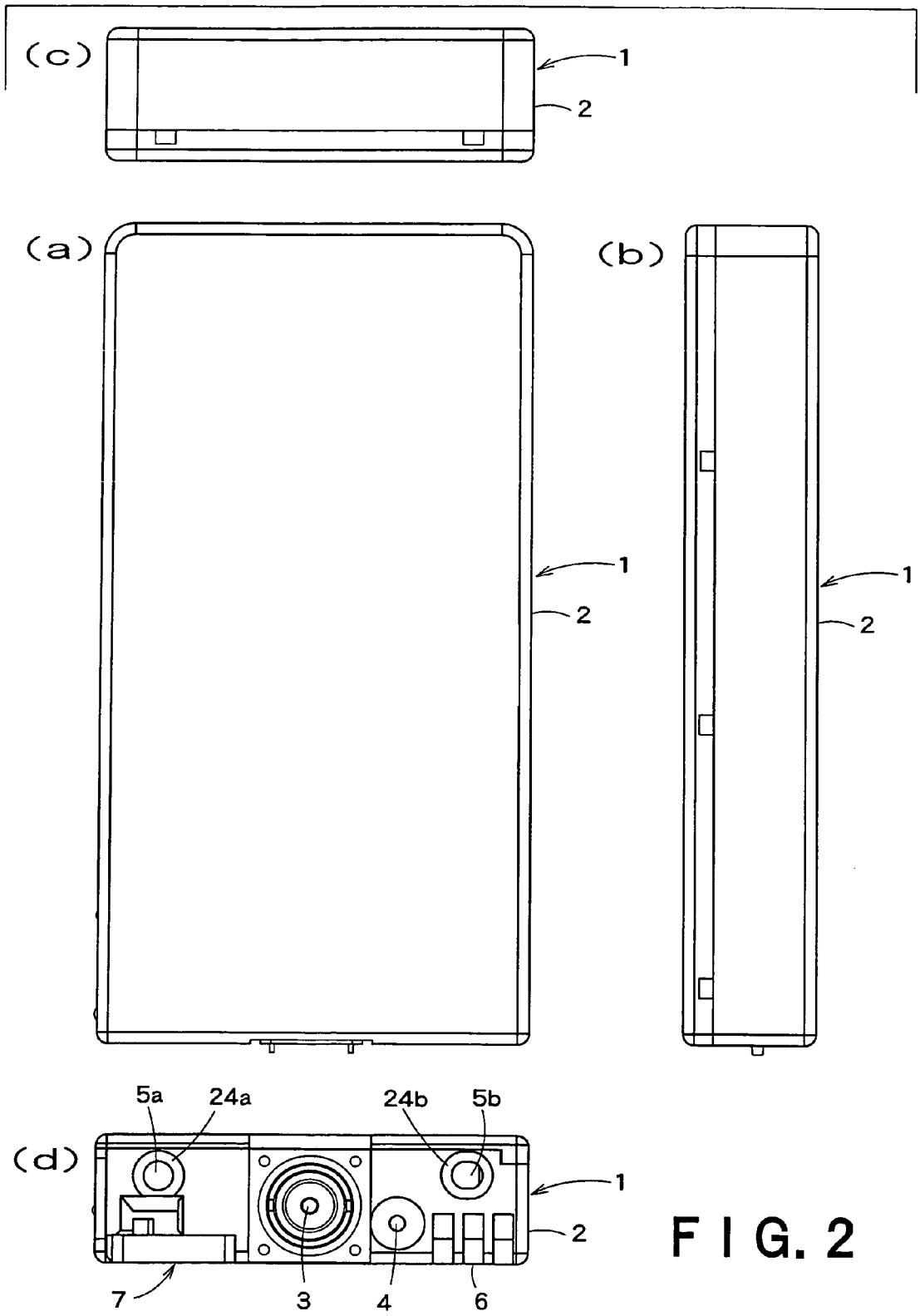
FIG. 2 is a drawing showing the ink cartridge of the ink jet recording apparatus as an embodiment of the present invention, and (a) is a plan view, (b) is a side view, (c) is a rear view, and (d) is a front view.
Figure 3:
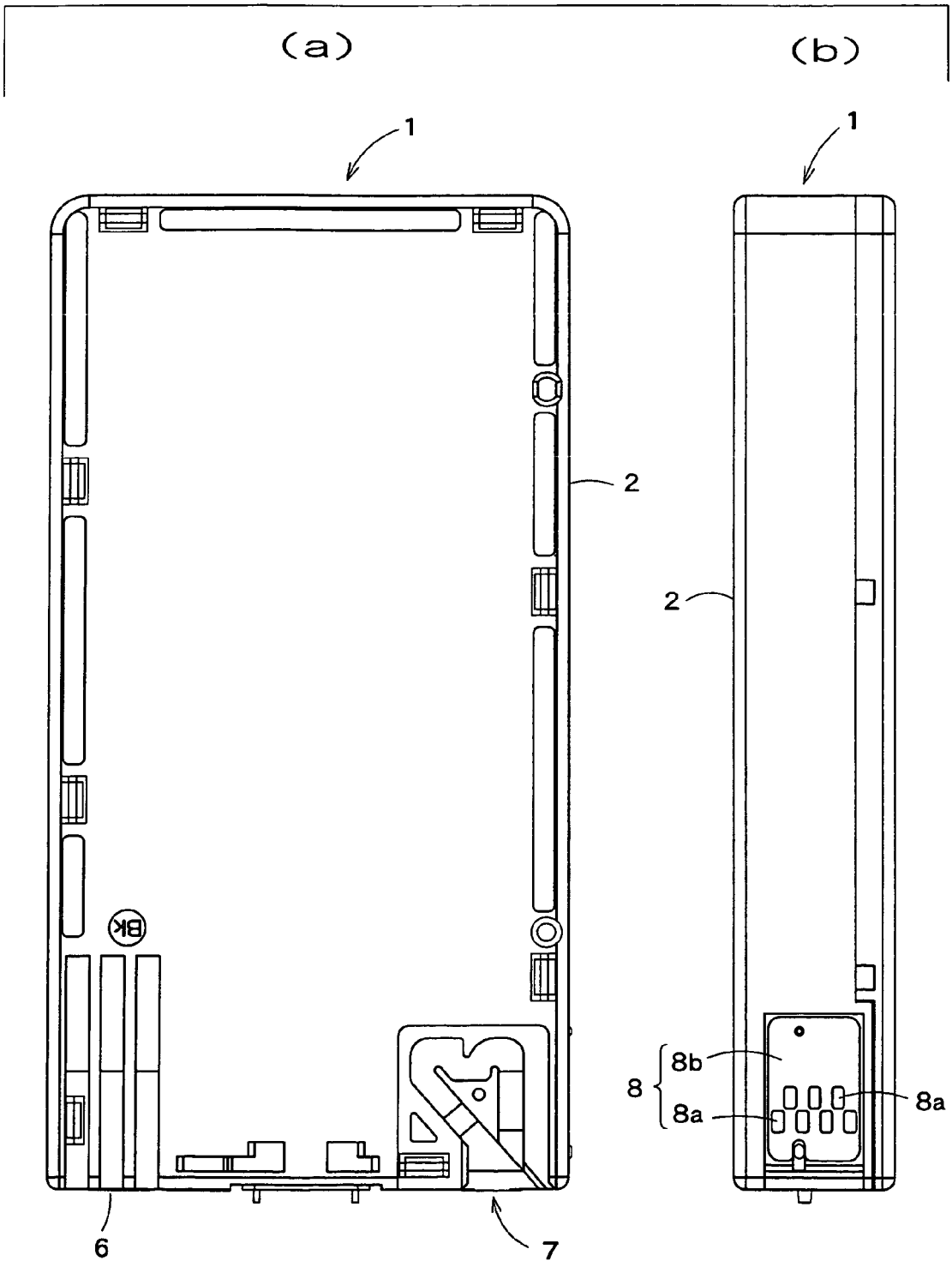
FIG. 3 is a drawing showing the ink cartridge of the ink jet recording apparatus as an embodiment of the present invention, and (a) is a bottom view, and (b) is a side view.
Figure 4:
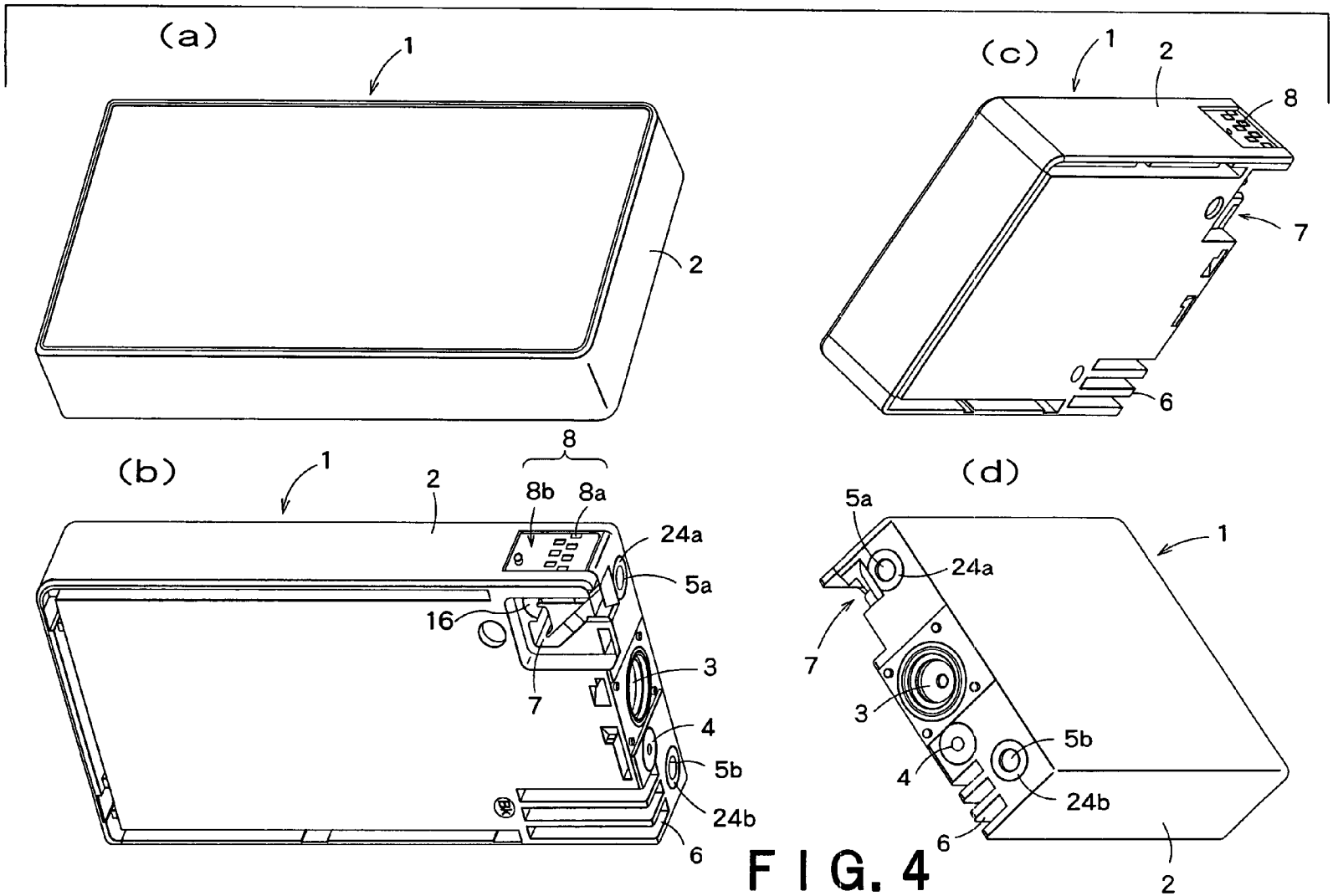
FIG. 4 is a perspective view showing the ink cartridge of the ink jet recording apparatus as an embodiment of the present invention, and (a) is a drawing viewed in the direction that the obliquely above rear can be seen, and (b) is a drawing viewed in the direction that the obliquely below front can be seen, and (c) is a drawing viewed in the direction that the obliquely below rear can be seen, and (d) is a drawing viewed in the direction that the obliquely above front can be seen.

FIGS. 2 to 4 are drawings showing the appearance and shape of an ink cartridge 1, and the ink cartridge 1 has a container body 2 in an almost rectangular parallelepiped shape, and on the front of the container body 2, an ink feed port 3 for sending ink to be fed to the ink jet recording apparatus 100 is formed.

Further, on the front of the container body 2, a pressurized fluid introducing port 4 for pressurizing ink in the container body 2 and introducing a pressurized fluid to be sent from the ink feed port 3 into the container body 2 is formed.

Furthermore, on the front of the container body 2, a pair of positioning holes 5*a* and 5*b* into which a pair of positioning projections installed in each cartridge mounting unit 101 are inserted are formed. Around the pair of positioning holes 5*a* and 5*b*, cartridge side positioning faces 24*a* and 24*b* in contact with the apparatus side positioning faces of the cartridge mounting unit 101 for positioning the ink cartridge 1 in the insertion direction are formed. The pair of positioning holes 5*a* and 5*b* and the pair of cartridge side positioning faces 24*a* and 24*b* form a cartridge side positioning structure.

Further, in one corner of the container body 2 including the front, that is, in the opposite corner of a cartridge side fixing structure 7 to the ink feed port 3, a malmounting preventive structure 6 is installed. The malmounting preventive structure 6, when mounting the ink cartridge 1 in the ink jet recording apparatus 100, to correctly mount an ink cartridge 1 of a predetermined ink kind in a predetermined position, is given a shape for preventing ink cartridges other than the ink cartridge of the correct ink kind from mounting.

Further, on the bottom of the container body 2, in the neighborhood of the front of the container body 2, in the opposite corner of the corner where the malmounting preventive structure 6 is installed, the cartridge side fixing structure (container side fixing structure) 7 is installed. The cartridge side fixing structure 7, in the state that the ink cartridge 1 is mounted in the container mounting unit 101, restricts releasably the movement of the ink cartridge 1 in the pull-out direction.

Further, in this example, the cartridge side fixing structure 7 is installed on the bottom of the container body 2. However, the forming position of the cartridge side fixing structure 7 is not limited to the bottom of the container body 2 and for example, it may be arranged on the top of the container body 2.

Further, on one side of the container body 2 close to the cartridge side fixing structure 7, a circuit substrate 8*b* loading an IC (a semiconductor storage element) for storing information such as the ink kind and residue is installed, and on the surface of the circuit substrate 8*b*, electrodes (cartridge side electrodes) 8*a* which are electrically connected to the IC and make contact with the apparatus side contacts of the recording apparatus body are installed, thus a storage device 8 is structured. The storage device 8, together with the cartridge side fixing structure 7, is arranged in the position of the container body 2 close to the ink feed port 3. Further, in this example, on the circuit substrate 8*b*, the storage element and electrodes 8*a* are formed. However, the storage element and electrodes 8*a* may be formed on an FPC and arranged in different positions of the container body 2.

Figure 5:
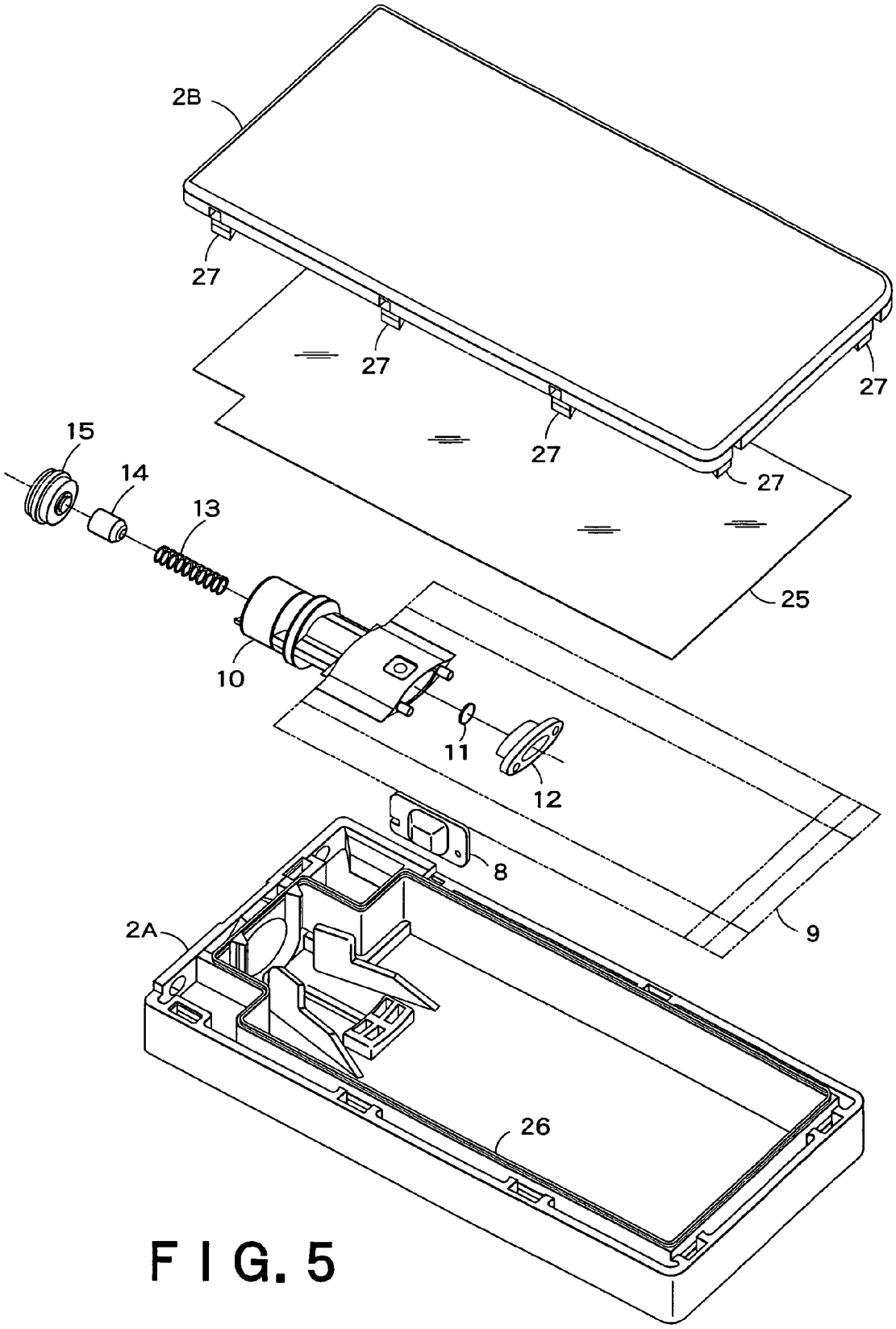
FIG. 5 is an exploded perspective view of the ink cartridge of the ink jet recording apparatus as an embodiment of the present invention.
Figure 6:
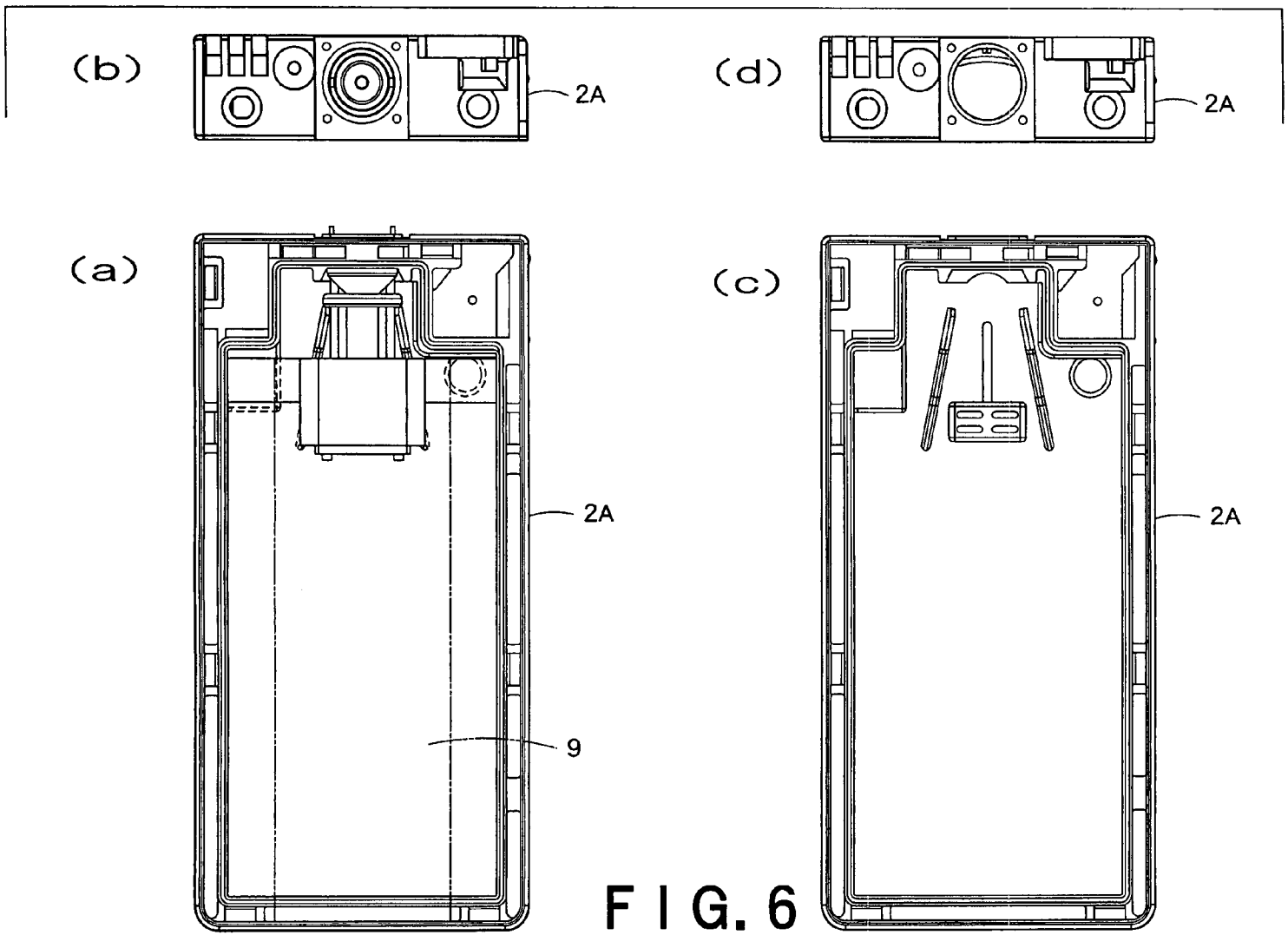
FIG. 6 is a drawing showing the state that from the ink cartridge of the ink jet recording apparatus as an embodiment of the present invention, a cover member thereof is removed, and (a) is a plan view showing the state that an ink bag is stored, and (b) is a front view of (a), and (c) is a plan view showing the state that no ink bag is stored, and (d) is a front view of (c)

FIG. 5 is an exploded perspective view of the ink cartridge 1 and the container body 2 is composed of a case body 2A having an opened top and a cover member 2B for sealing the top opening of the case body 2A. FIG. 6 shows the state that from the ink cartridge 1, the cover member 2B is removed.

As shown in FIGS. 5 and 6, in the container body 2, an ink bag 9 having a flexible ink storage unit (indicated by a dashed line for explanation) with ink filled is stored. In the ink bag 9, a port 10 for delivering the internal ink to the outside is installed. At the internal end of the port 10, a check valve 11 is internally arranged and a cover 12 is attached. On the other hand, at the external end of the port 10, a spring seat 14 pressed by a spring 13 is internally arranged and a seal feed cover 15 is attached.

To a weld 26 formed so as to surround the outer periphery of the area storing the ink bag 9 of the case body 2A, a film 25 is fixed by thermal welding to form an internal closed space. The closed space is structured so as to close a pressurized fluid (pressurized air in this embodiment) introduced from the pressurized fluid introducing port 4 without leaking externally, press the ink storage unit of the ink bag 9 by the pressurized fluid, thereby feed ink to the outside. Furthermore, the cover member 2B is fixed to the case body 2A by engagement projections 27 formed on the cover member 2B so as to cover the film 25, thereby protects the film 25 and prevents unnecessary expansion of the film 25 at the time of pressurization.

Figure 7:
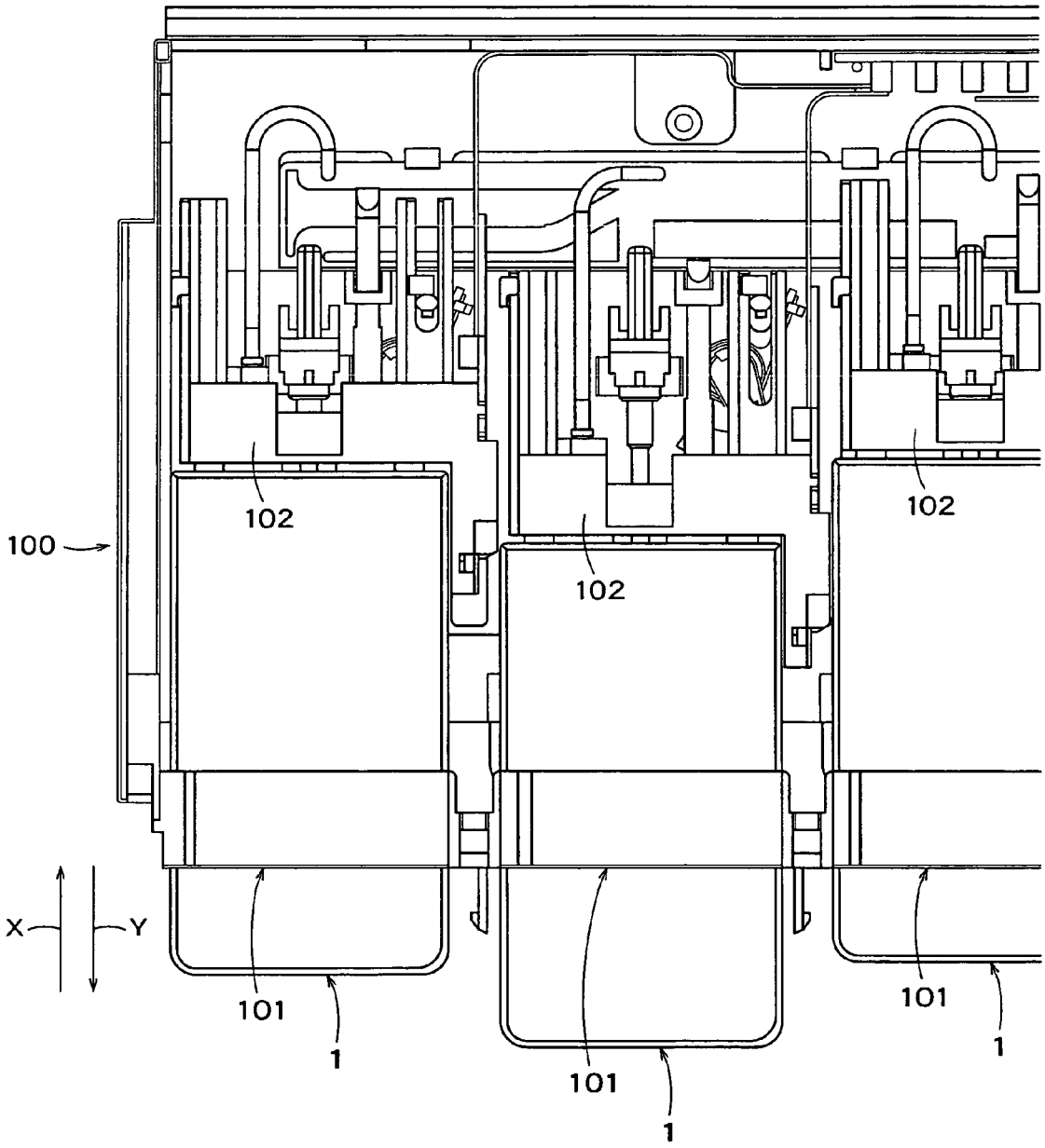
FIG. 7 is a plan view showing the state that the ink cartridge of the ink jet recording apparatus as an embodiment of the present invention is mounted in the cartridge mounting unit in which the inside of the recorder can be seen.
Figure 8:
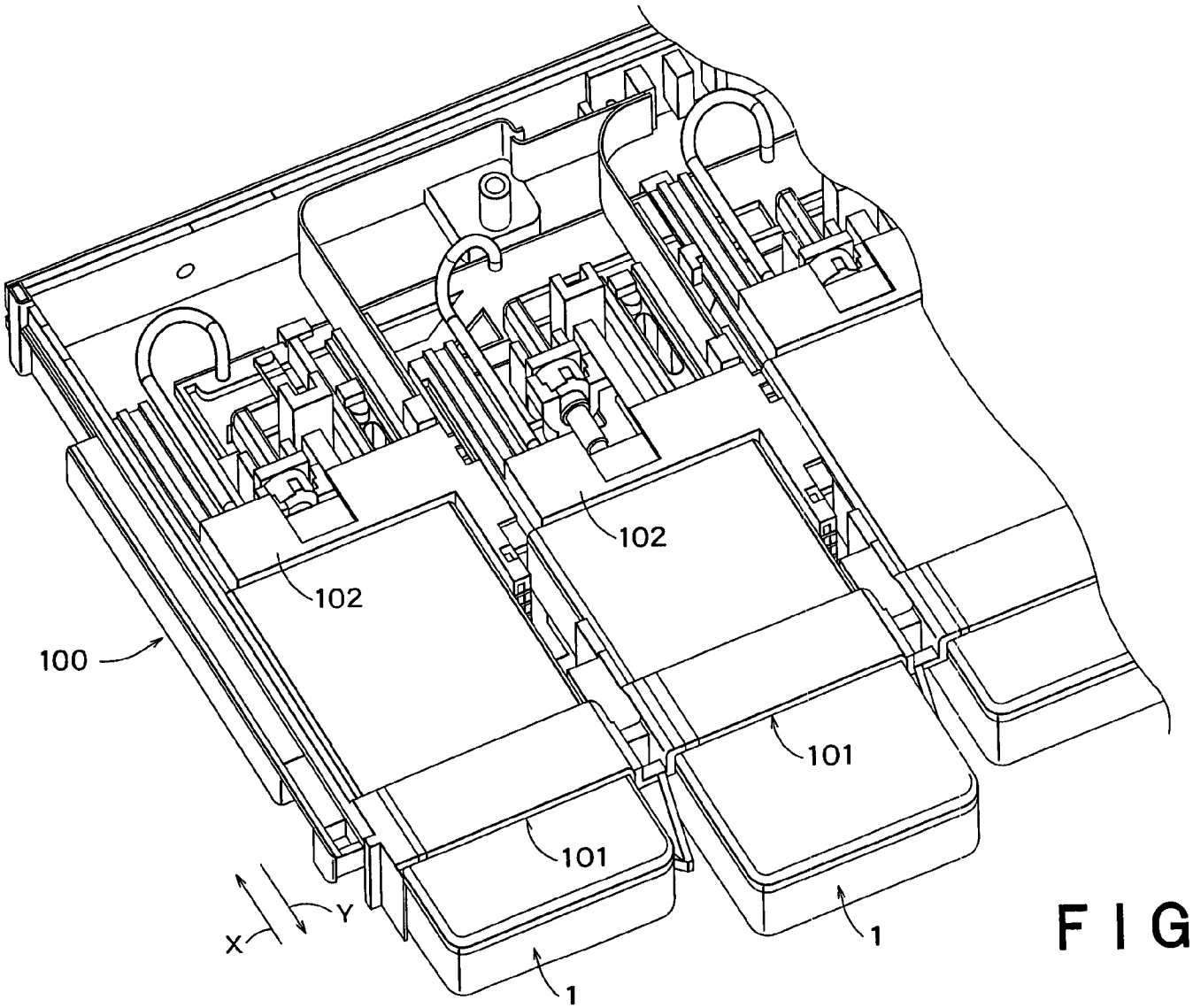
FIG. 8 is a perspective view showing the state that the ink cartridge of the ink jet recording apparatus as an embodiment of the present invention is mounted in the cartridge mounting unit in which the inside of the recorder can be seen.

FIGS. 7 and 8 show the state that the ink cartridges 1 are mounted in the cartridge mounting units 101 of the ink jet recording apparatus 100 and in the cartridge mounting units 101, the slider members (translationally movable members) 102 to which the front of each of the ink cartridges 1 is connected are installed. The slider members 102 are installed so as to slide in the directions of inserting and pulling out the ink cartridges 1 and are pressed in the direction (the pull-out direction Y) opposite to the insertion direction X of the ink cartridges 1 by an elastic means. The slider members 102 pressed by the elastic means, together with the elastic means, form a pressing means for giving the pressing force in the pull-out direction Y opposite to the insertion direction X at the time of mounting to the ink cartridges 1.

Figure 9:
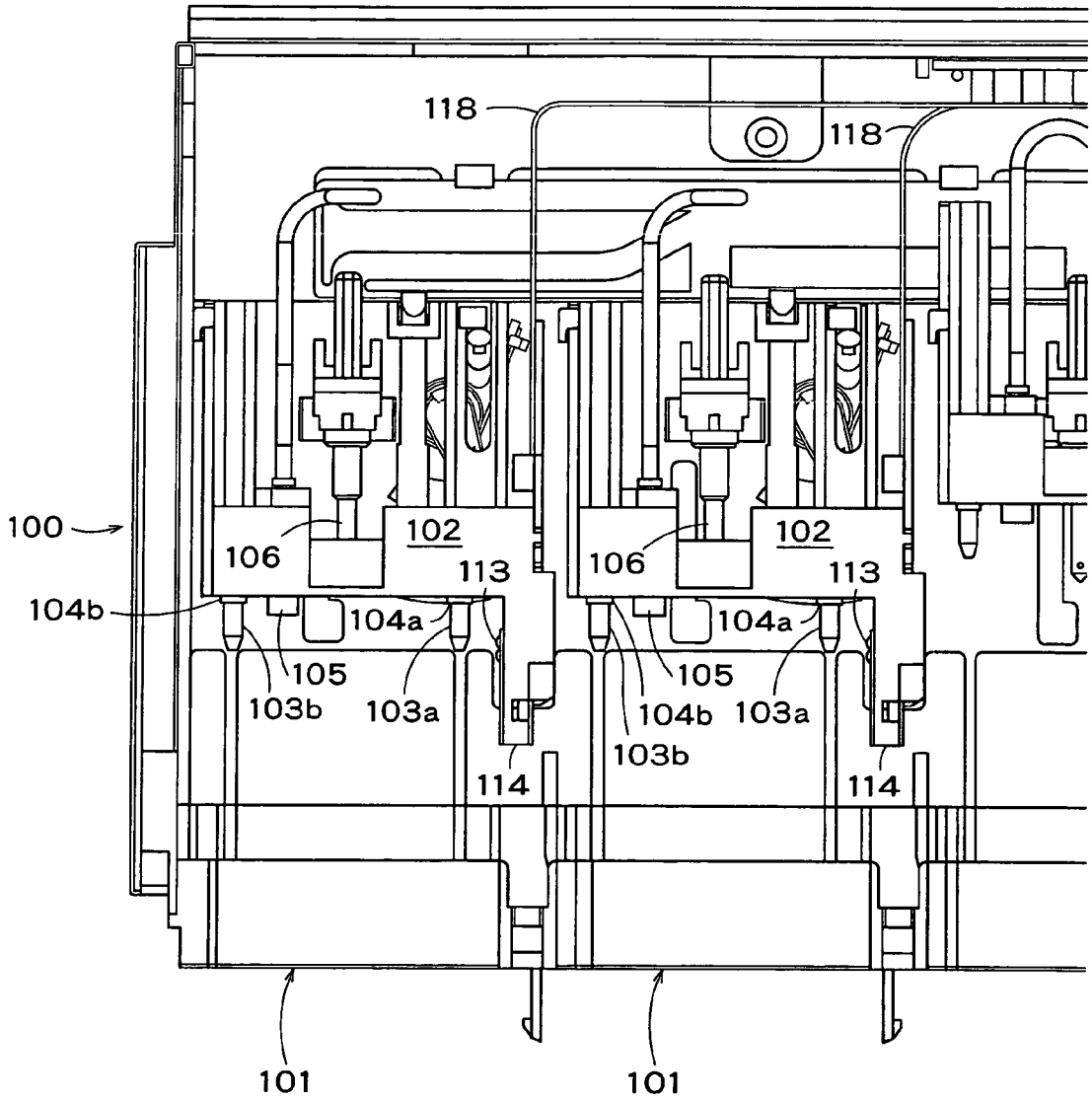
FIG. 9 is a plan view showing the cartridge mounting unit of the ink jet recording apparatus shown in FIG. 7 which is shown so that the inside of the recorder can be seen when the ink cartridge is not mounted.
Figure 10:
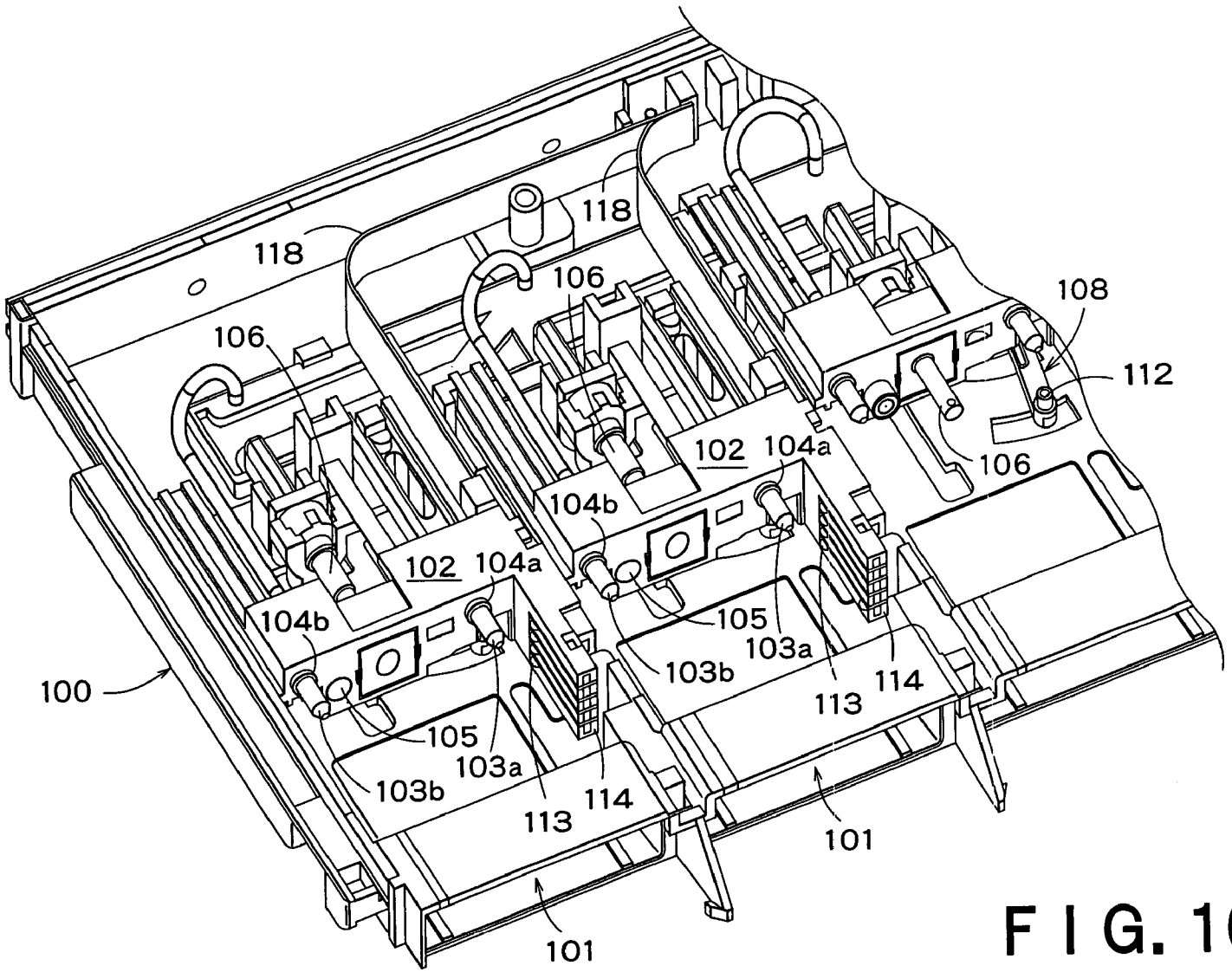
FIG. 10 is a perspective view showing the cartridge mounting unit of the ink jet recording apparatus shown in FIG. 8 which is shown so that the inside of the recorder can be seen when the ink cartridge is not mounted.

FIGS. 9 and 10 show the cartridge mounting units 101 when the ink cartridges 1 are not mounted. On the faces of the slider members 102 corresponding to the fronts of the ink cartridges, a pair of positioning projections 103*a* and 103*b* are installed, and on the bases of the positioning projections 103*a* and 103*b*, apparatus side positioning faces 104*a* and 104*b* are respectively installed at the shoulders thereof. The pair of positioning projections 103*a* and 103*b* and the pair of apparatus side positioning faces 104*a* and 104*b* form an apparatus side positioning structure on the cartridge connection faces of the slider members 102.

And, when the ink cartridges 1 are connected to the slider members 102, into the pair of positioning holes 5*a* and 5*b* of the front of each of the ink cartridges 1, the pair of positioning projections 103*a* and 103*b* are inserted and the pair of cartridge side positioning faces 24*a* and 24*b* and the pair of apparatus side positioning faces 104*a* and 104*b* make contact with each other.

Among the pair of positioning holes 5*a* and 5*b*, the pair of positioning projections 103*a* and 103*b*, the pair of cartridge side positioning faces 24*a* and 24*b*, and the pair of apparatus side positioning faces 104*a* and 104*b*, the positioning hole 5*a*, the positioning projection 103*a*, the cartridge side positioning face 24*a*, and the apparatus side positioning face 104*a* have a function for positioning the corresponding ink cartridge 1 more correctly with respect to the corresponding slider member 102. Especially, the positioning of each ink cartridge 1 in the insertion direction is correctly executed by the cartridge side positioning face 24*a* and the apparatus side positioning face 104*a*.

As shown in FIG. 4(*b*), the positioning hole 5*a* and the cartridge side positioning face 24*a* which are used for correct positioning are arranged near the storage device 8 including the electrodes 8*a*. As mentioned above, in the neighborhood of the storage device 8, the positioning hole 5*a*, the cartridge side positioning face 24*a*, and the cartridge side fixing structure 7 are arranged.

Further, so that the positioning projection 103*a* inserted in the positioning hole 5*a* and the cartridge side fixing structure 7 are overlaid in the direction of the thickness of the container body 2, the positioning hole 5*a* and the cartridge side fixing structure 7 are arranged.

When each ink cartridge 1 is mounted on the corresponding cartridge mounting unit 101, by the positioning hole 5*a*, the positioning projection 103*a*, the cartridge side positioning face 24*a*, and the apparatus side positioning face 103*a*, the ink cartridge 1 is correctly positioned with respect to the corresponding slider member 102, and into a stopper 18 of a guide groove 16 of the container body 2, a stopper pin 112 of the apparatus side fixing structure 107 is inserted and held.

Furthermore, as shown in FIGS. 9 and 10, on the face of each slider member 102 opposite to the front of the corresponding ink cartridge, a pressurized fluid port 105 connected to the pressurized fluid introducing port 4 of the ink cartridge 1 is installed.

Further, as shown in FIGS. 9 and 10, at one end of the front of each slider member 102, contact projections 114 having arranged apparatus side contacts 113 connected to the electrodes 8*a* of the storage device 8 are installed. The contact projections 114 are arranged, among the pair of positioning projections 103*a* and 103*b* and the pair of apparatus side positioning faces 104*a* and 104*b*, on the sides of the positioning projection 103*a* and the apparatus side positioning face 104*a*. And, the apparatus side contact 113 is arranged in the neighborhood of the positioning projection 103*a* and the apparatus side positioning face 104*a*.

Further, in each cartridge mounting unit 101, an ink feed needle 106 to be inserted into the ink feed port 3 of the corresponding ink cartridge 1 is fixed and arranged.

Further, as shown in FIGS. 9 and 10, to the rear of each slider member 102, one end of a flexible electric cable 118 is connected. The other end of the electric cable 118 is connected to the recording apparatus body including a controller.

Figure 11:
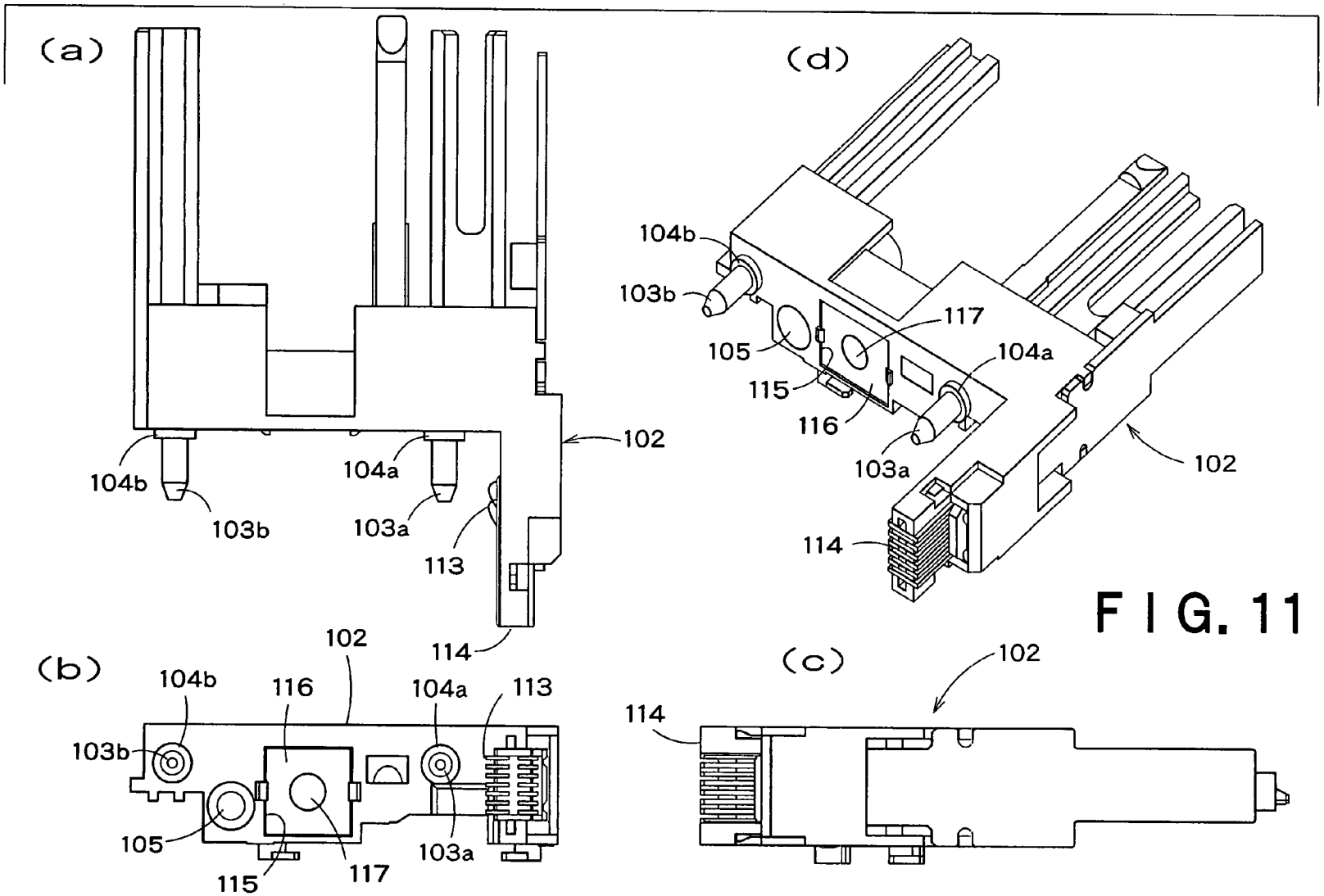
FIG. 11 is a drawing showing a slider member of the cartridge mounting unit of the ink jet recording apparatus as an embodiment of the present invention, and (a) is a plan view, (b) is a front view, (c) is a side view, and (d) is a perspective view.

FIGS. 11(*a*) to 11(*d*) show an enlarged slider member 102, and as shown in FIGS. 11(*b*) and 11(*d*), at the central part of the front of the slider member 102, an opening 115 is formed through and inside the opening 115, an ink absorption member 116 composed of a material capable of absorbing ink is installed.

At the central part of the ink absorption member 116, a cylindrical ink feed needle insertion hole 117 is formed through and the ink feed needle 106 to be inserted into the ink feed port 3 of the ink cartridge 1 is inserted through the ink feed needle insertion hole 117.

Figure 12A:
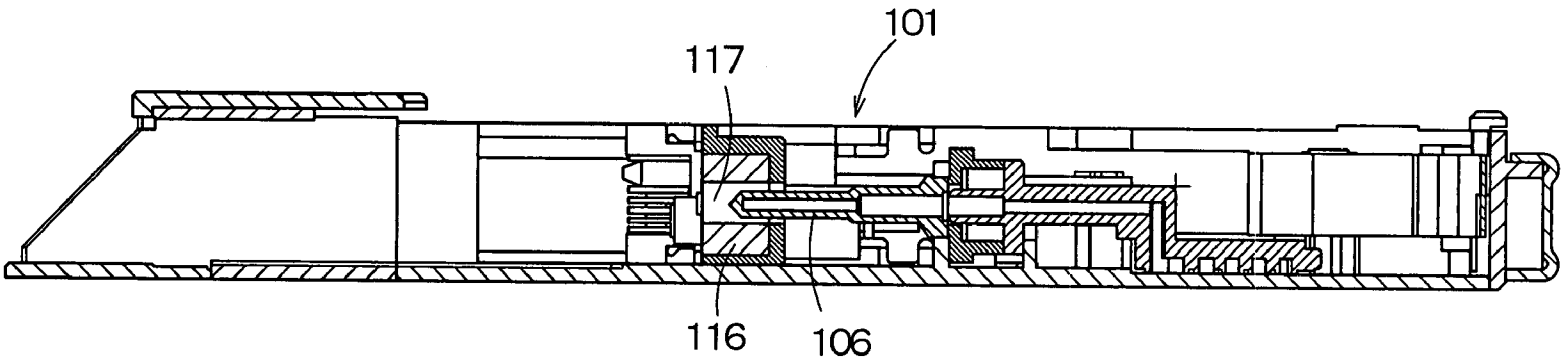
FIGS. 12A and 12B are sectional views of the cartridge mounting unit of the ink jet recording apparatus as an embodiment of the present invention.

As shown in FIG. 12A, when the ink cartridge 1 is not mounted in the cartridge mounting unit 101, that is, when the slider member 102 is not pressed in, the end of the ink feed needle 106 is positioned in the ink absorption member 116. Further, at the end of the ink feed needle 106, an ink flow hole 106*a* (refer to FIG. 13) for allowing ink to flow out from the ink feed needle 106 is formed.

Figure 12B:
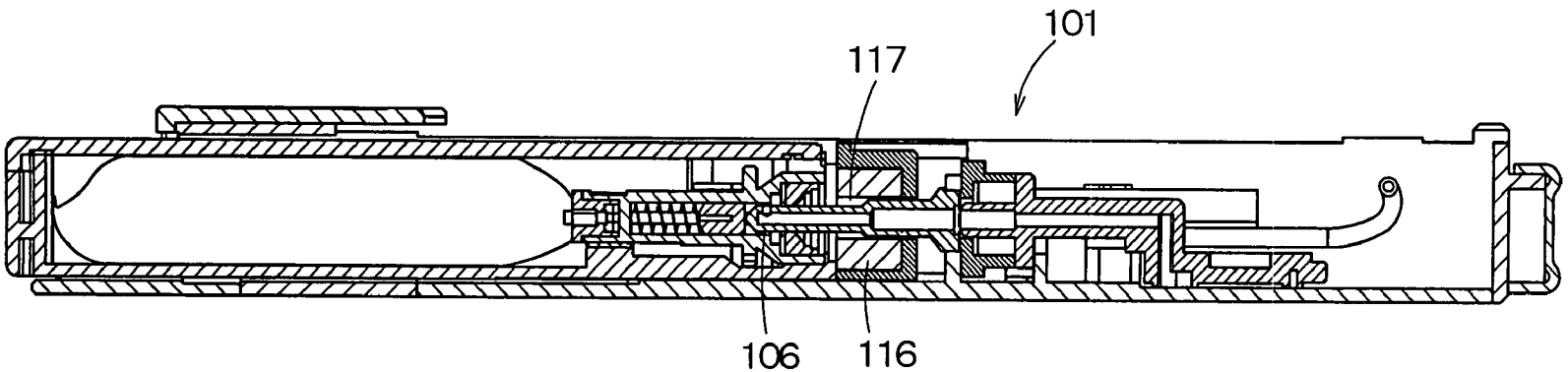

And, as shown in FIG. 12B, since the ink cartridge 1 is mounted in the cartridge mounting unit 101 and the slider member 102 is pressed in, the end of the ink feed needle 106 is projected from the front of the ink feed needle insertion hole 117 and is inserted through the ink feed port 3 of the ink cartridge 1.

Figure 13:
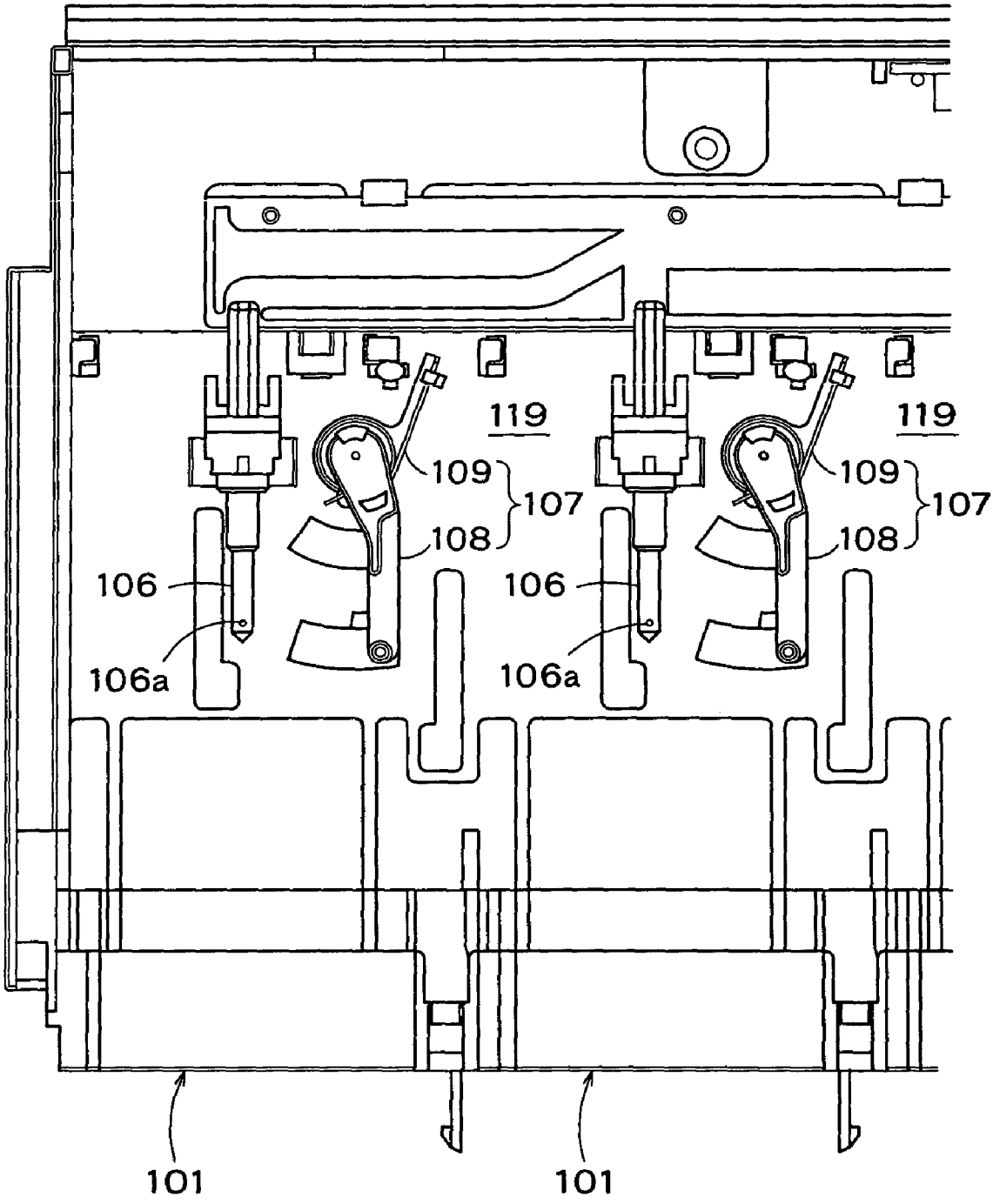
FIG. 13 is a plan view showing the state that the slider is removed from the cartridge mounting unit of the ink jet recording apparatus shown in FIG. 7 in which the inside of the recorder can be seen.
Figure 14:
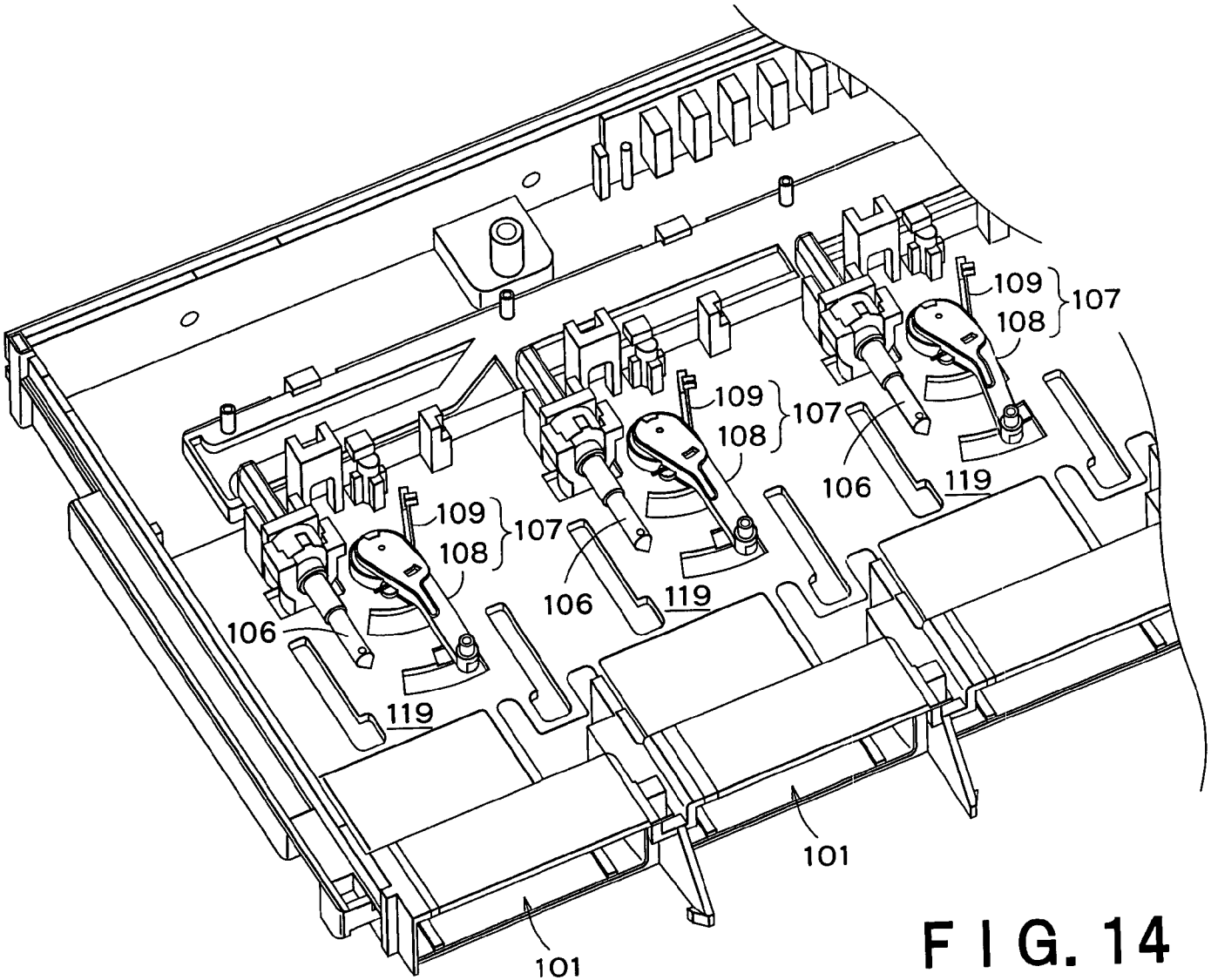
FIG. 14 is a perspective view showing the state that the slider is removed from the cartridge mounting unit of the ink jet recording apparatus shown in FIG. 8 in which the inside of the recorder can be seen.

FIGS. 13 and 14 show the state that the slider members 102 are taken out from the cartridge mounting units 101. Inside the cartridge mounting units 101, the ink feed needles 106 are fixed, and as mentioned above, the ink cartridges 1 are pressed in together with the slider members, thus the ink feed needles 106 are inserted into the ink feed ports 3 of the ink cartridges 1.

Further, inside the cartridge mounting units 101, the apparatus side fixing structures 107 for releasably restricting the movement of the ink cartridges 1 in the pull-out direction in cooperation with the cartridge side fixing structures 7 of the ink cartridges 1 are installed.

Each apparatus side fixing structure 107 has a rotation lever member 108, and the rotation lever member 108 is supported by a support plate 119 rotatably around the proximal end thereof and is pressed by a spring member 109 in one rotational direction (in the counterclockwise direction in FIG. 13). The support plate 119 forms a part of the structural member of the cartridge mounting unit 101.

Figure 15A:
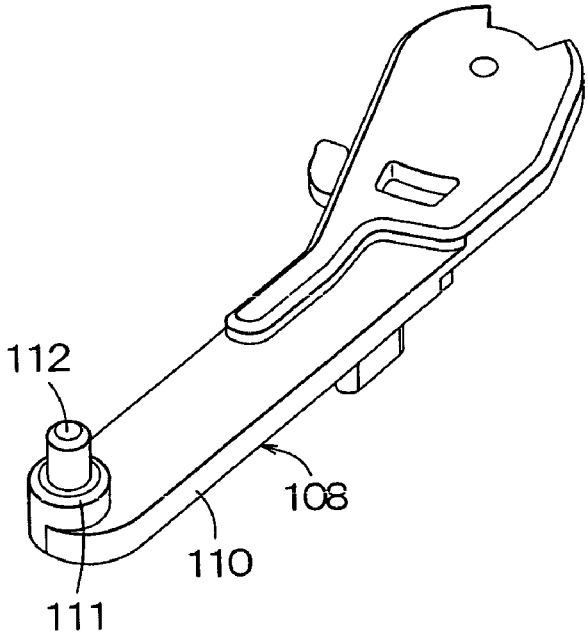
FIGS. 15A and 15B are perspective views showing the rotation lever member of the cartridge mounting unit shown in FIGS. 13 and 14 which are enlarged.
Figure 15B:
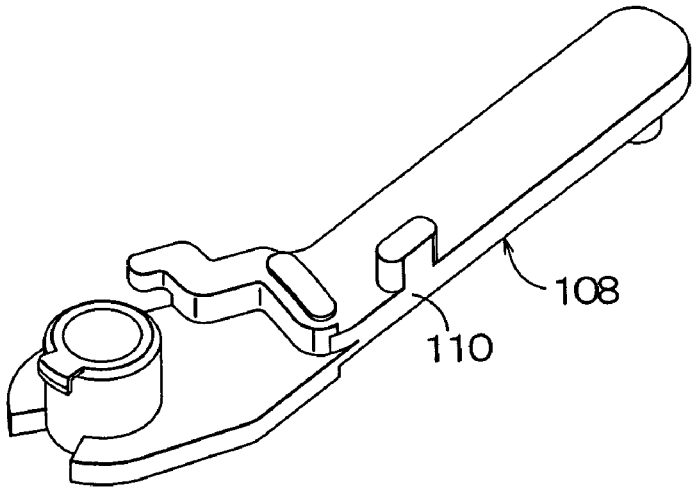
Figure 16A:
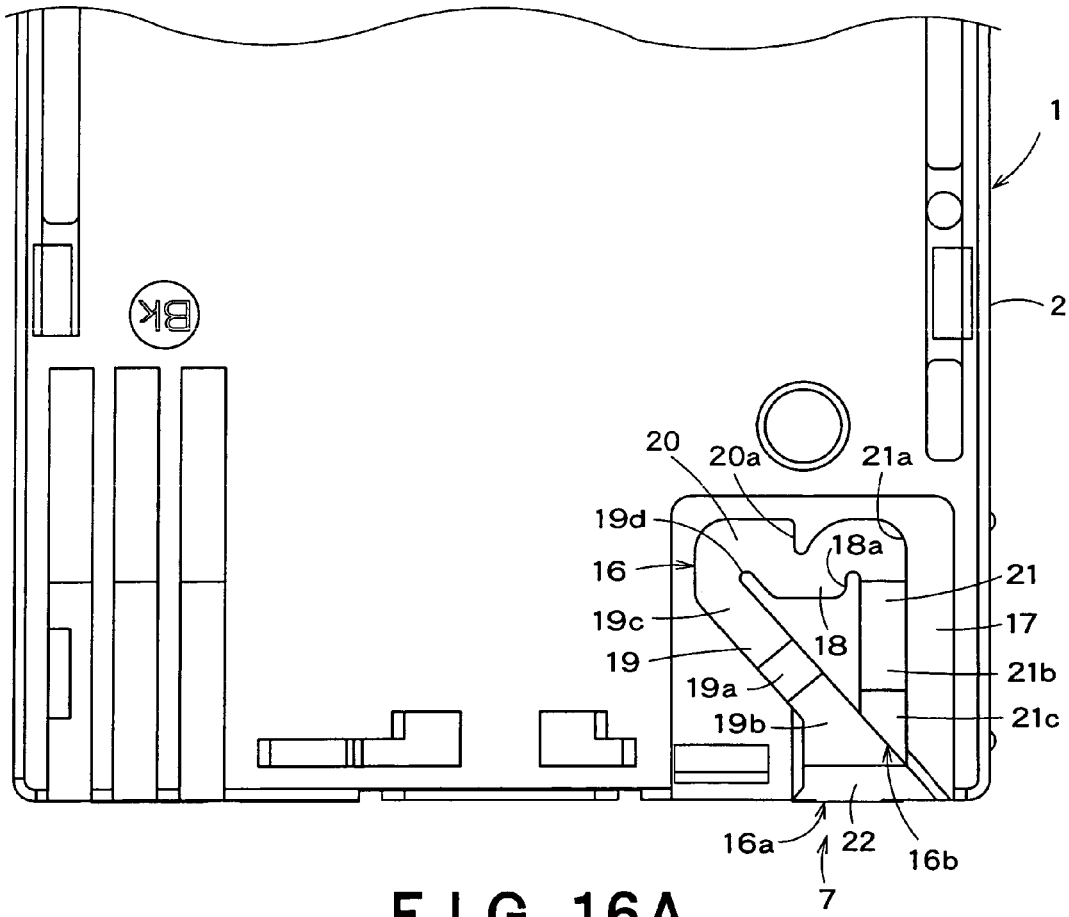
FIGS. 16A and 16B are drawings showing the ink cartridge of the ink jet recording apparatus as an embodiment of the present invention which is enlarged.
Figure 16B:
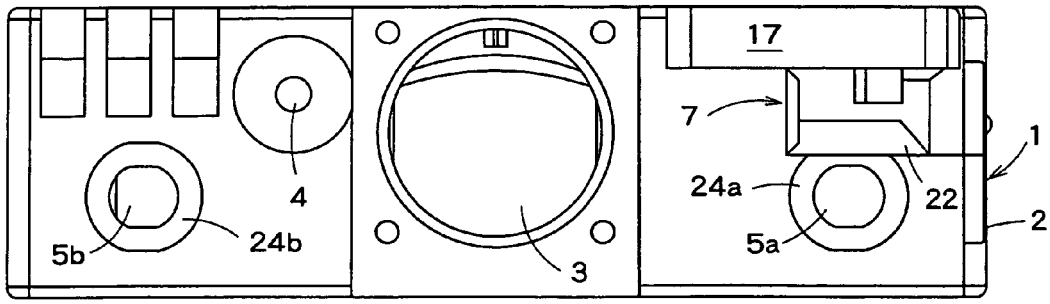
Figure 17A:
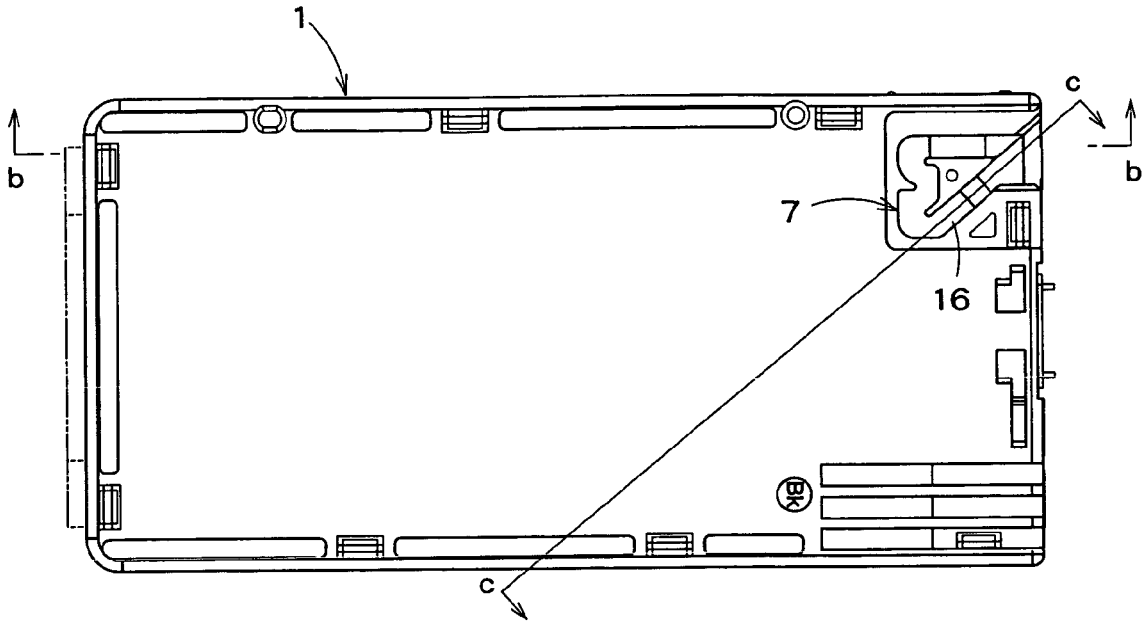
FIGS. 17A, 17B and 17C are drawings for explaining the depth and shape of the guide groove of the ink cartridge of the ink jet recording apparatus as an embodiment of the present invention, and the sectional views along the lines b-b and c-c shown in FIG. 17A are shown respectively in FIGS. 17B and 17C.
Figure 17B:
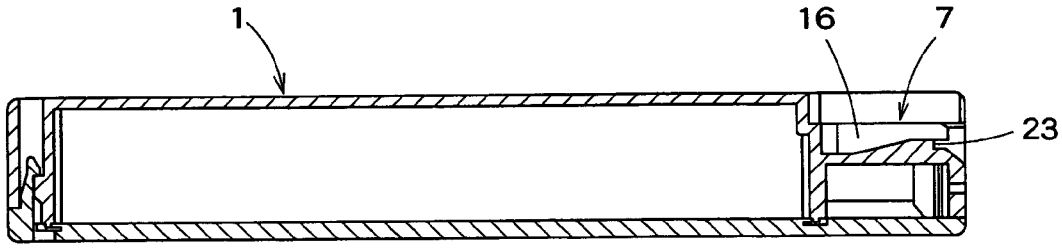
Figure 17C:
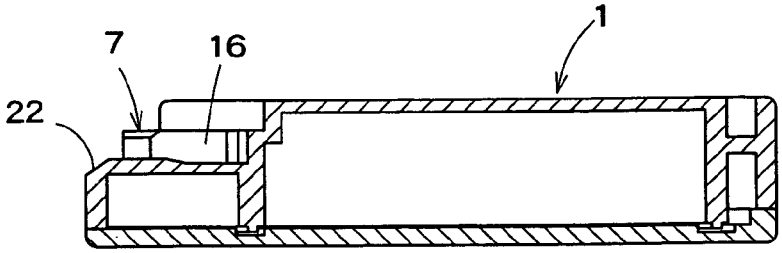

As shown in FIGS. 15A and 15B, the rotation lever member 108 has a long and narrow lever body 110, an almost columnar pin mounting part 111 installed at the end of the lever body 110, and an almost columnar stopper pin 112 having a smaller diameter than that of the pin mounting part 111 which is installed on the top of the pin mounting part 111.

As shown in FIGS. 16A, 16B, 17A, 17B and 17C, the cartridge side fixing structure 7 is composed of a guide groove 16 with a rectangular section in which the stopper pin 112 is inserted. In the corner of the rear of the cartridge in the neighborhood of the positioning hole 5*a* and the cartridge side positioning face 24*a* which are used for high precision positioning, a concavity 17 is formed and on the bottom of the concavity 17, the guide groove 16 is engraved. The bottom of the guide groove 16 is perpendicular to the side of the container body 2 in which the storage device 8 is arranged.

And, when mounting or demounting the ink cartridge 1 from the cartridge mounting unit 101, the stopper pin 112 of the rotation lever member 108 of the apparatus side fixing structure 107 is guided by the guide groove 16 of the cartridge side fixing structure 7.

The guide groove 16 includes the stopper 18 with which the stopper pin 112 is engaged when the ink cartridge 1 is mounted in the cartridge mounting unit 101 and restricting the movement of the ink cartridge 1 in the pull-out direction.

Further, the guide groove 16 has an entrance side guide part 19 for guiding the stopper pin 112 when inserting the ink cartridge 1 into the cartridge mounting unit 101, an intermediate guide part 20 for leading the stopper pin 112 to the stopper 18 when pressing back the ink cartridge 1 inserted in the cartridge mounting unit 101 in the pull-out direction, and an exit side guide part 21, when removing the ink cartridge 1 from the cartridge mounting unit 101, for guiding the stopper pin 112 disconnected from the stopper 18 to the exit of the guide groove 16 by pressing the ink cartridge 1 in the insertion direction.

The main part (straight part) of the entrance side guide part 19 of the guide groove 16 is extended at a slope of about 30° to about 50° to the insertion and pull-out direction of the ink cartridge 1. Further, the terminal of the entrance side guide part 19 is given a curved shape by a projected wall 19*d*.

Further, at an entrance 16*a* of the guide groove 16, an entrance inclined face 22 is formed. The entrance inclined face 22 is inclined so that the groove depth gradually becomes shallower in the movement direction of the stopper pin 112 relatively moving in correspondence with the insertion operation of the ink cartridge into the cartridge mounting unit 101.

The width of the entrance inclined face 22 is set wider than the groove width of the main part of the guide groove 16 formed in almost the same width including the stopper 18. Further, the width of the entrance inclined face 22 is set larger than the diameter of the pin mounting part 111 to which the stopper pin 112 is attached. On the other hand, the groove width of the main part of the guide groove 16 is set smaller than the diameter of the pin mounting part 111.

Furthermore, in the entrance side guide part 19 between the entrance inclined face 22 and the stopper 18, a deep groove forming inclined face 19*a* inclined so that the guide groove 16 becomes deeper in the movement direction of the stopper pin 112 relatively moving in correspondence with the insertion operation of the ink cartridge 1 into the cartridge mounting unit 101 is formed. Between the deep groove forming inclined face 19*a* and the entrance inclined face 22, a flat part 19*b* is formed. Further, a flat part 19*c* is formed following the deep groove forming inclined face 19*a*.

The depth of the shallowest part of the guide groove 16 formed by the entrance inclined face 22, that is, the groove depth at the flat part 19*b* is smaller than the length of the stopper pin 112. Further, the depth of the deepest part of the guide groove 16 formed by the deep groove forming inclined face 19*a*, that is, the groove depth at the flat part 19*c* is larger than the length of the stopper pin 112.

Furthermore, the intermediate guide part 20 of the guide groove 16 includes a temporary stop side wall 20*a* for temporarily stopping the stopper pin 112 moving toward the stopper 18 at the point of time when the ink cartridge 1 is inserted sufficiently deep into the cartridge mounting unit 101 before the stopper 18.

Further, the stopper 18 of the guide groove 16 includes a last stop side wall 18*a* for receiving and stopping the stopper pin 112, which is released from the temporary stop side wall 20*a* and moves to the stopper 18 when the ink cartridge 1 inserted into the cartridge mounting unit 101 sufficiently deep is pressed back in the pull-out direction, at a predetermined stop position.

Further, at the starting edge of the exit side guide part 21, a curved side wall 21*a* is formed, and a straight inclined face 21*b* is formed following the curved side wall 21*a*, and moreover, following it, a straight flat part 21*c* is formed.

Further, an exit 16*b* of the guide groove 16 is connected to the entrance 16*a*, thus the guide groove 16 forms a loop as a whole. At the connection of the entrance 16*a* and the exit 16*b*, the groove depth at the exit 16*b* is shallower than the groove depth at the entrance 16*a*, thus at the connection, a level difference 23 (FIG. 17B) is formed. The level difference 23 prevents the stopper pin 112 from entering the flat part 21*c* when the ink cartridge 1 is inserted into the cartridge mounting unit 101.

Next, by referring to FIGS. 18 and 19, the operation of the stopper pin 112 in the guide groove 16 when the ink cartridge 1 is mounted or demounted will be explained. Further, the arrow Z in FIG. 18 indicates the pressing direction of the rotation lever member 108 by the spring member 109. Further, FIG. 19 shows changes in the position of the stopper pin 112 in the rotation axial center direction (vertical direction) when the ink cartridge 1 is mounted or demounted and the positions of the stopper pin 112 indicated by symbols A to J shown in FIG. 19 correspond to the positions of the stopper pin 112 indicated by symbols A to J shown in FIG. 18.

Figure 18:
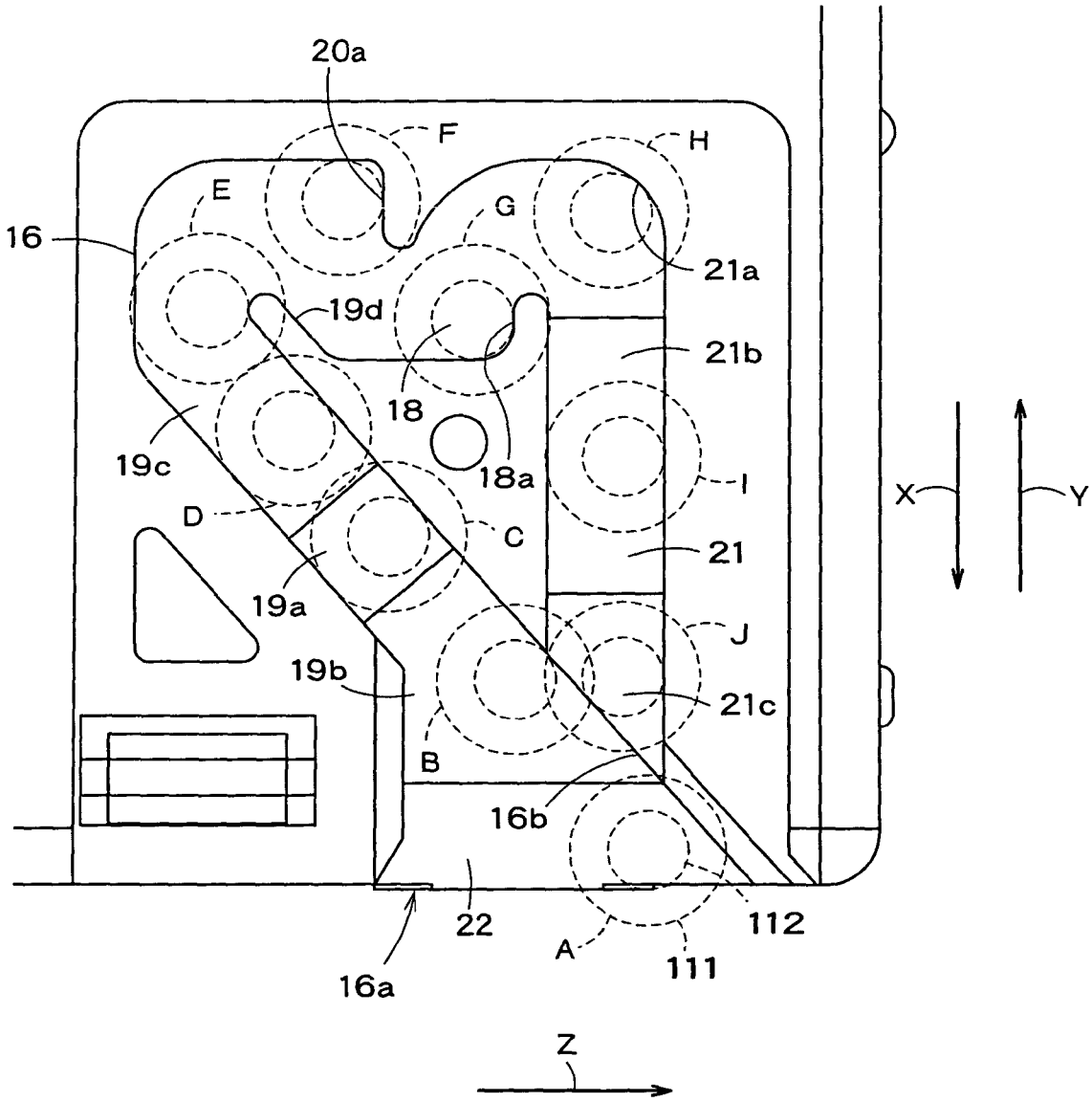
FIG. 18 is a drawing for explaining the operation of a stopper pin in the guide groove when the ink cartridge of the ink jet recording apparatus as an embodiment of the present invention is mounted or demounted.
Figure 19:
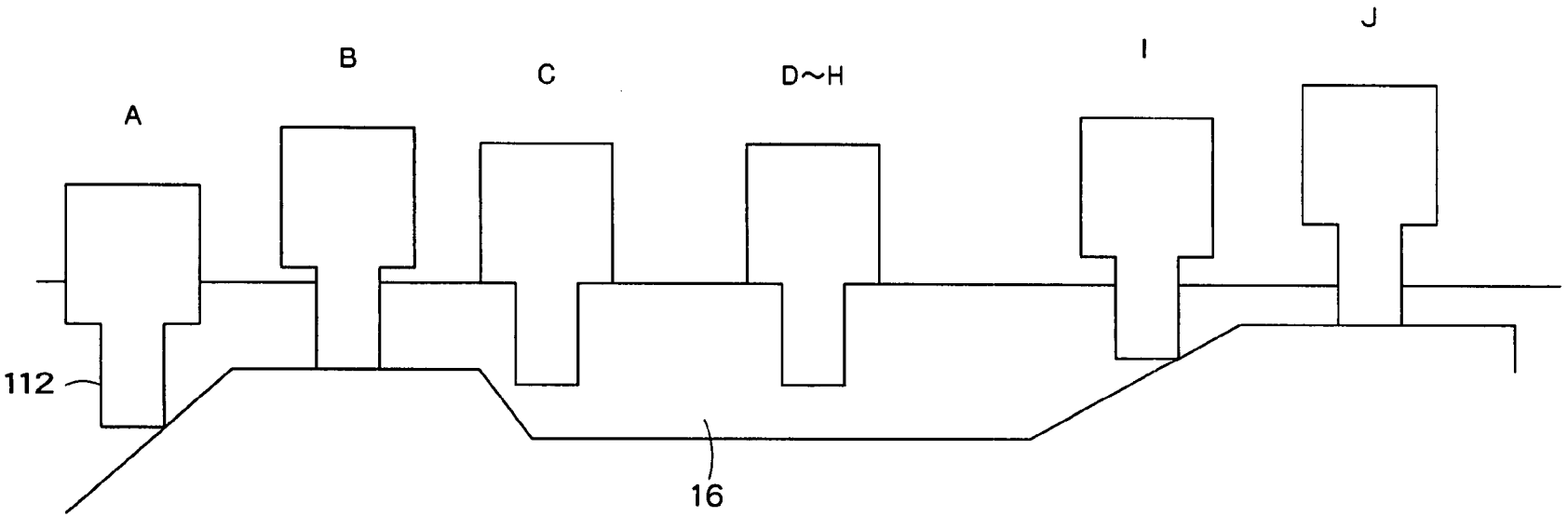
FIG. 19 is a drawing for explaining the vertical displacement of the stopper pin when the ink cartridge of the ink jet recording apparatus as an embodiment of the present invention is mounted or demounted.

Firstly, the ink cartridge 1 is inserted into the cartridge mounting unit 101 and is connected to the slider member 102, then the ink cartridge 1 is additionally pressed in the insertion direction X against the pressing force of the slider member 102, thus the stopper pin 112 of the rotation lever member 108 is inserted into the entrance 16*a* of the guide groove 16 (the position A shown in FIGS. 18 and 19).

At the entrance 16*a* of the guide groove 16, the entrance inclined face 22 is formed, so that the stopper pin 112 is displaced in the opposite direction of the direction of the groove depth by sliding on the entrance inclined face 22. By doing this, the rotation lever member 108 or the member for supporting the rotation lever member 108 is elastically deformed, thus force for pressing the stopper pin 112 toward the bottom of the guide groove 16 is generated.

Further, at the point of time when the end of the stopper pin 112 first makes contact with the entrance inclined face 22, the top of the pin mounting part 111 is positioned below the level of the edge of the guide groove 16 and the groove depth is changed so that the top of the pin mounting part 111 exceeds the level of the edge of the guide groove 16 in the course that the stopper pin 112 moves on the entrance inclined face 22.

And, at the point of time when the stopper pin 112 passes the entrance inclined face 22 and runs on the flat part 19*b* (the position B shown in FIGS. 18 and 19), only the stopper pin 112 is inserted in the guide groove 16 and the pin mounting part 111 is positioned outside the guide groove 16. The reason is that the depth of the guide groove 16 at the flat part 19*b* is set smaller than the length of the stopper pin 112.

When the entrance inclined face 22 is installed at the entrance 16*a* of the guide groove 16 like this and the stopper pin 112 is inserted into the entrance 16*a* of the guide groove 16, the stopper pin 112 can be prevented from being caught by the front of the ink cartridge 1 and the stopper pin 112 can be inserted smoothly and surely into the entrance 16*a* of the guide groove 16.

Further, the entrance inclined face 22 is formed and the groove depth at the flat part 19*b* is set smaller than the length of the stopper pin 112, so that as shown in this example, even when the width of the entrance 16*a* of the guide groove 16 is set wide and the groove width following it is set narrow, the pin mounting part 111 will not be held in the narrow width part of the guide groove 16. And, when the width of the entrance 16*a* of the guide groove 16 is set wide, the stopper pin 112 can be surely inserted into the guide groove 16.

When the ink cartridge 1 is further pressed in the insertion direction X, the stopper pin 112 passes the flat part 19*b* and is displaced in the direction of the groove depth by sliding on the deep groove forming inclined face 19*a* (the position C shown in FIGS. 18 and 19).

And, at the point of time when the stopper pin 112 passes the deep groove forming inclined face 19*a* and reaches the position of the flat part 19*c* (the position D shown in FIGS. 18 and 19), the periphery of the top of the pin mounting part 111 is engaged with the edge of the guide groove 16 and is pressed against the edge. The reason is that the elastic deformation of the rotation lever member 108 generated when the stopper pin 112 passes the entrance inclined face 22 still remains at this point of time. When the periphery of the top of the pin mounting part 111 is engaged with the edge of the guide groove 16 like this, the rotation lever member 108 makes contact with the face (the bottom of the concavity 17) including the edge of the guide groove 16 and the stopper pin 112 can be prevented from displacement from the guide groove 16.

Further, at the point of time when the stopper pin 112 reaches the position of the flat part 19*c* (the position D shown in FIGS. 18 and 19), the end of the stopper pin 112 is isolated from the bottom of the guide groove 16. The reason is that the groove depth at the flat part 19*c* is set larger than the length of the stopper pin 112.

When the ink cartridge 1 is pressed further in the insertion direction X and the stopper pin 112 passes the neighboring position (the position E shown in FIGS. 18 and 19) of the end of the projected wall 19*d* positioning at the end of the entrance side guide part 19, the stopper pin 112 moves in the direction of the arrow Z by the pressing force of the spring member 109. And, the stopper pin 112 collides with the temporary stop side wall 20*a* and stops (the position F shown in FIGS. 18 and 19) and it clicks at this time. By this click, a user can confirm that the ink cartridge 1 is inserted sufficiently deep.

Next, when the pressing of the ink cartridge 1 in the insertion direction X is released by the user, the ink cartridge 1 is slightly pressed back in the pull-out direction Y by the pressing force of the slider member 102. By doing this, the engagement of the stopper pin 112 at the temporary stop side wall 20*a* is released and the stopper pin 112 moves in the direction of the arrow Z by the pressing force of the spring member 109. And, the stopper pin 112 collides with the last stop side wall 18*a* and stops at the stop position (the position G shown in FIGS. 18 and 19) and it clicks at this time. By this click, the user can confirm that the ink cartridge 1 is fixed to the cartridge mounting unit 101.

In this case, the depth of the guide groove 16 at the stopper 18 is set larger than the length of the stopper pin 112 in the same way as with the flat part 19*c* of the entrance side guide part 19. Further, by the elastic deformation of the rotation lever member 108 generated when the stopper pin 112 passes the entrance inclined face 22, the stopper pin 112 is pressed toward the bottom of the guide groove 16.

Therefore, the stopper pin 112 fixed at a predetermined stop position at the stopper 18 enters inside the guide groove 16 through the length thereof and the periphery of the top of the pin mounting part 111 is engaged with the edge of the guide groove 16. By doing this, by the force applied to the stopper pin 112 by the engagement with the side wall of the guide groove 16, the stopper pin 112 (particularly the base thereof) can be prevented from creeping. Namely, when the stopper pin 112 is slightly caught by the guide groove 16, the force applied to the base of the stopper pin 112 is increased by the so-called lever principle. However, as mentioned above in this example, the stopper pin 112 is caught by the guide groove 16 through the whole length thereof, so that the stopper pin 112 can be prevented from creeping Further, since the stopper pin 112 is caught sufficiently deep by the guide groove 16, the stopper pin 112 will not be displaced from the guide groove 16. Further, this effect is not limited only to the stopper 18 and even while the stopper pin 112 is relatively moving in the guide groove 16, when the periphery of the top of the pin mounting part 111 slides on the edge of the guide groove 16, the effect is produced.

Further, the stopper pin 112 is pressed toward one side of the ink cartridge 1 by the spring member 109 and on this side, the electrode 8*a* of the storage device 8 is installed. Therefore, the pressing force of the spring member 109 acts so as to press the electrode 8*a* of the storage device 8 toward the apparatus side contact 113 (FIGS. 9 and 10) via the stopper pin 112 and the last stop side wall 18*a*, thus the connection state between the electrode 8*a* of the storage device 8 and the apparatus side contact 113 can be kept satisfactorily.

Next, when taking out the ink cartridge 1 from the cartridge mounting unit 101, the ink cartridge 1 is slightly pressed in the insertion direction X by the user. Then, the engagement of the stopper pin 112 on the last stop side wall 18*a* is released and the stopper pin 112 moves in the direction of the arrow Z by the pressing force of the spring member 109. And, the stopper pin 112 collides with the curved side wall 21*a* of the exit side guide part 21 of the guide groove 16 and stops temporarily (the position H shown in FIGS. 18 and 19) and it clicks at this time. By this click, the user can confirm that the fixing of the ink cartridge 1 to the cartridge mounting unit 101 is released.

Then, when the pressing of the ink cartridge 1 in the insertion direction X by the user is released and the ink cartridge 1 moves in the pull-out direction Y, the stopper pin 112 moves along the straight inclined face 21*b* of the exit side guide part 21 (the position I shown in FIGS. 18 and 19). At this time, the end of the stopper pin 112 makes contact with the inclined face 21*b* on the way and the stopper pin 112 is displaced in the opposite direction of the groove depth direction. The stopper pin 112 passing the inclined face 21*b* passes the flat part 21*c* (the position J shown in FIGS. 18 and 19) and passes the exit 16*b* of the guide groove 16.

Next, the connection process of the ink cartridge 1 to the ink feed needle 106 when mounting the ink cartridge 1 in the cartridge mounting unit 101 will be explained.

When the ink cartridge 1 is inserted into the cartridge mounting unit 101, firstly, into the positioning holes 5*a* and 5*b* of the ink cartridge 1, the positioning projections 103*a* and 103*b* of the slider member 102 are inserted. Further, to the pressurized fluid introducing port 4 of the ink cartridge 1, the pressurized fluid port 105 of the slider member 102 is connected. Furthermore, the electrode 8*a* of the storage device 8 and the apparatus side contact 113 are connected and the two are conducted.

At the point of time when the electrode 8*a* of the storage device 8 and the apparatus side contact 113 are connected, the ink feed needle 106 is not inserted yet into the ink feed port 3 of the ink cartridge 1. Therefore, at this point of time, data can be read from the storage device 8, and whether a correct ink cartridge 1 is inserted or not is decided, and when a wrong ink cartridge 1 is inserted, before the ink feed needle 106 is inserted into the ink feed port 3 of the concerned wrong ink cartridge 1, it can be exchanged with a correct ink cartridge 1.

By doing this, flow of wrong ink into the ink flow path of the apparatus body can be surely prevented. Further, when the ink feed port 3 of the ink cartridge 1 inserted by mistake is covered with a seal, it can be avoided to unnecessarily tear the seal.

And, the ink cartridge 1 is connected to the slider member 102 and then the ink cartridge 1 is further pressed in the insertion direction X against the pressing force of the slider member 102, thus the ink feed needle 106 is inserted through the ink feed port 3 of the ink cartridge 1.

Next, the separation process of the ink cartridge 1 from the ink feed needle 106 when taking out the ink cartridge 1 from the cartridge mounting unit 101 will be explained.

As mentioned above, when the ink cartridge 1 is pressed in the insertion direction X, the fixing of the ink cartridge 1 by the cartridge side fixing structure 7 and the apparatus side fixing structure 107 is released and the ink cartridge 1 can move in the pull-out direction Y. The ink cartridge 1 released from the fixing firstly moves in the pull-out direction Y together with the slider member 102 and by this movement, the ink feed needle 106 is pulled out from the ink feed port 3 of the ink cartridge 1.

At the point of time when the ink feed needle 106 is pulled out from the ink feed port 3 like this, the connection between the electrode 8*a* of the storage device 6 and the apparatus side contact 113 is maintained, so that data can be transferred between the apparatus body and the storage device 8. As mentioned above, even after the fixing of the ink cartridge 1 is released, data can be transferred between the storage device 8 of the ink cartridge 1 and the apparatus body and a data reading error can be prevented.

When the ink cartridge 1 is further moved in the pull-out direction Y, the slider member 102 cannot move at a predetermined stop position. When the ink cartridge 1 is moved further in the pull-out direction Y from here, the pressurized fluid port 105 is separated from the pressurized fluid introducing port 4 of the ink cartridge 1 and the positioning projections 103*a* and 103*b* are pulled out from the positioning holes 5*a* and 5*b* of the ink cartridge 1. Further, the electrode 8*a* of the storage device 8 is separated from the apparatus side contact 113.

Figure 20B:
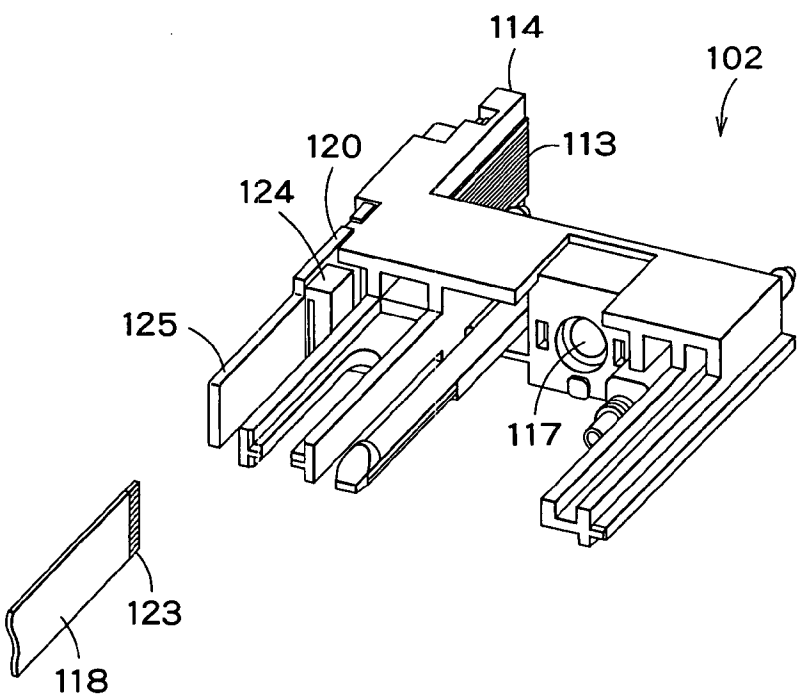
FIGS. 20A and 20B are drawings showing a slider member of the cartridge mounting unit of the ink jet recording apparatus as an embodiment of the present invention and an electric cable before connecting to the slider member.
Figure 20A:
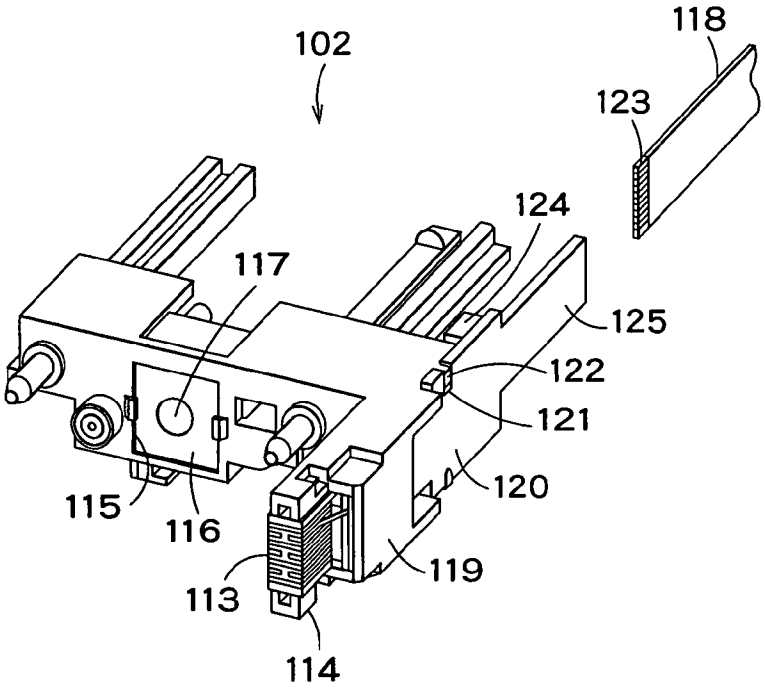

FIGS. 20A and 20B show the enlarged slider member 102 and at the central part of the front of the slider member 102, the opening 115 is formed through. Inside the opening 115, the ink absorption member 116 composed of a material capable of absorbing ink is formed.

The ink absorption member 116 has the cylindrical ink feed needle insertion hole 117 formed through the central part thereof and the ink feed needle 106 to be inserted through the ink feed port 3 of the ink cartridge 1 is inserted through the ink feed needle insertion hole 117.

The contact projection 114 installed at one end of the front of the slider member 102 has the cylindrical part 119 and a contact substrate 120 with the apparatus side contact 113 formed is inserted through the cylindrical part 119 of the contact projection 114. On the contact substrate 120, a pair of upper and lower notches 121 are formed and a pair of upper and lower convexities 122 formed on the slider member 102 are fit into the notches 121 of the contact substrate 120. The contact substrate 120 is formed separately from the slider member 102 and then is attached so as to be inserted through the cylindrical part 119 of the slider member 102.

Further, on the inside face of the rear of the contact substrate 120, a connector 124 to which a conductive end 123 of the electric cable 118 is connected is installed.

Furthermore, on the contact substrate 120, a substrate extended part (cable fixing part) 125 extending in the insertion direction of the ink cartridge 1 is integrally formed.

Figure 21B:
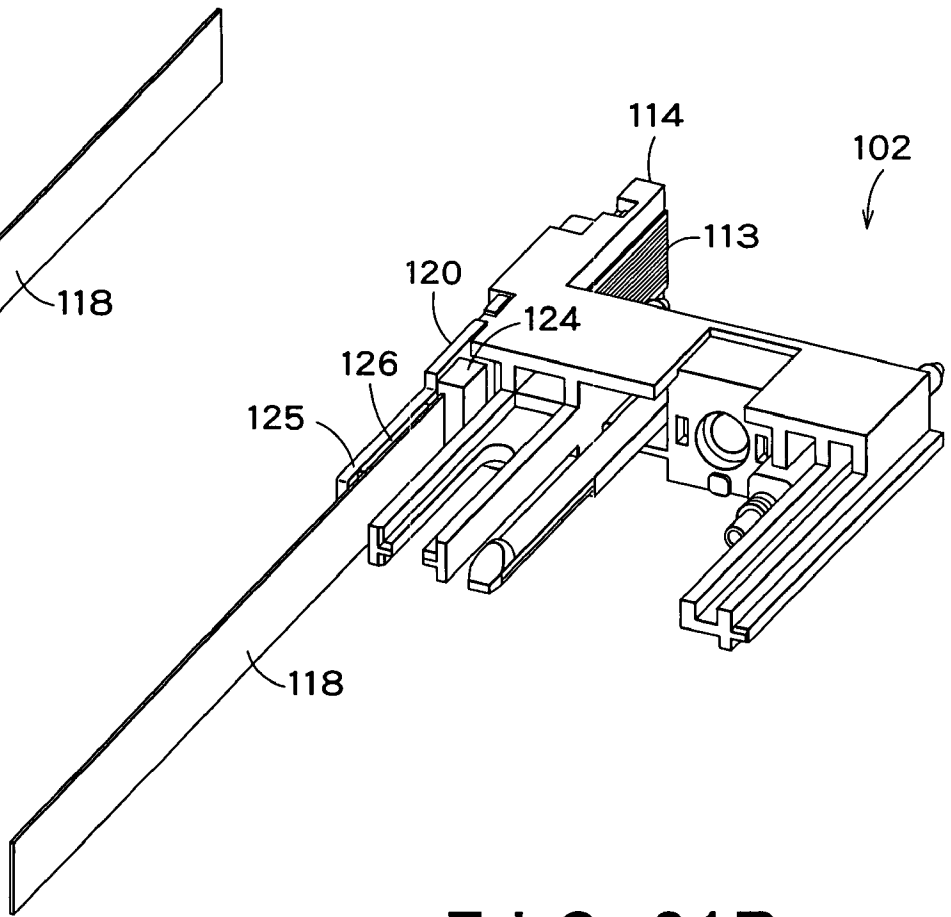
FIGS. 21A and 21B are drawings showing the slider member of the cartridge mounting unit of the ink jet recording apparatus as an embodiment of the present invention and the electric cable connected to the slider member.
Figure 21A:
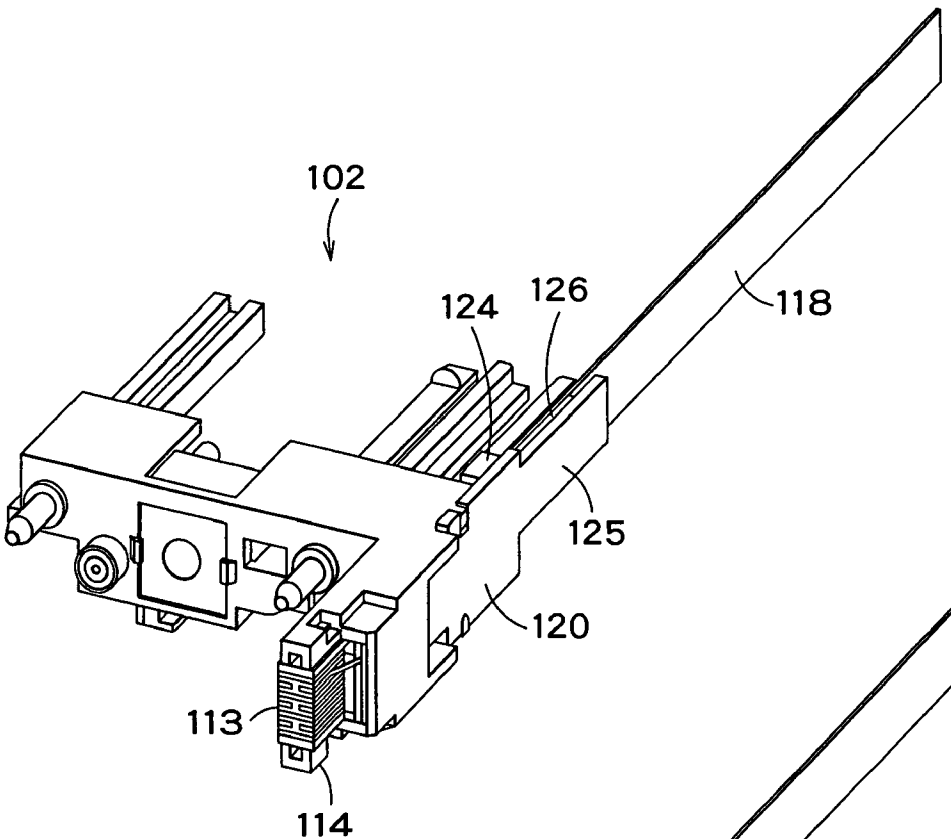

And, in this embodiment, as shown in FIGS. 21A and 21B, the electric cable 118 connected to the connector 124, at the part other than the conductive end 123, is fixed to the substrate extended part 125 by a double-coated tape 126 pre-applied on the electric cable 118.

Next, one modification of the aforementioned embodiment will be explained by referring to FIGS. 22A and 22B.

Figure 22B:
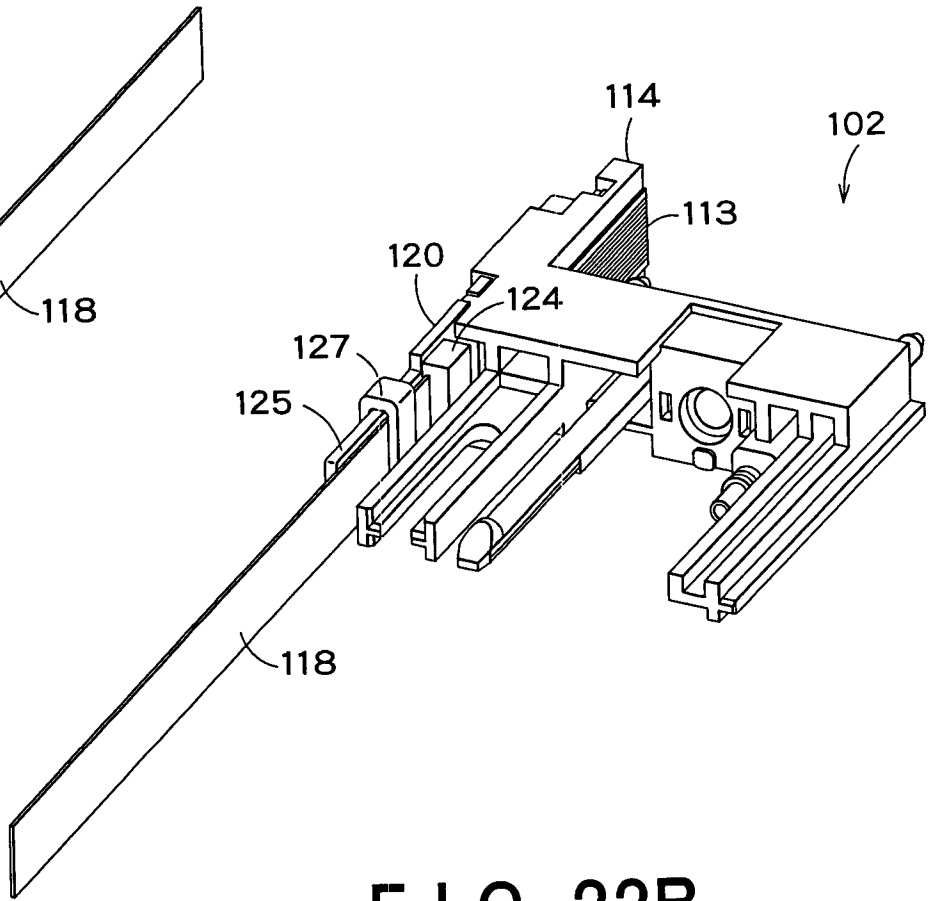
FIGS. 22A and 22B are drawing showing a slider member and an electric cable connected to the slider member of a modification of an embodiment of the present invention.
Figure 22A:
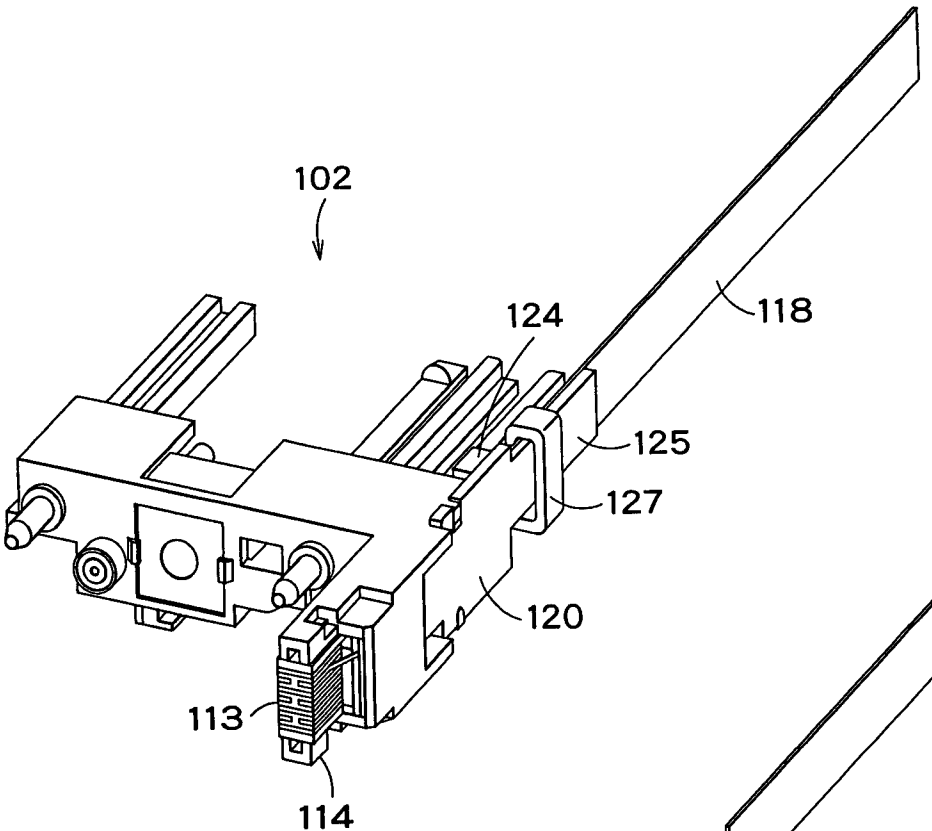

As shown in FIGS. 22A and 22B, in this embodiment, as a means for fixing the electric cable 118 to the substrate extended part 125, a ring member 127 fit into the overlaid part of the electric cable 118 and the substrate extended part 125 is used.

In this constitution, before the conductive end 123 of the electric cable 118 is connected to the connector 124, the electric cable 118 is inserted through the ring member 127, and the conductive end 123 is connected to the connector 124, and then the ring member 127 is pressure-fit and fixed to the overlaid part of the electric cable 118 and the substrate extended part 125.

Figure 23:
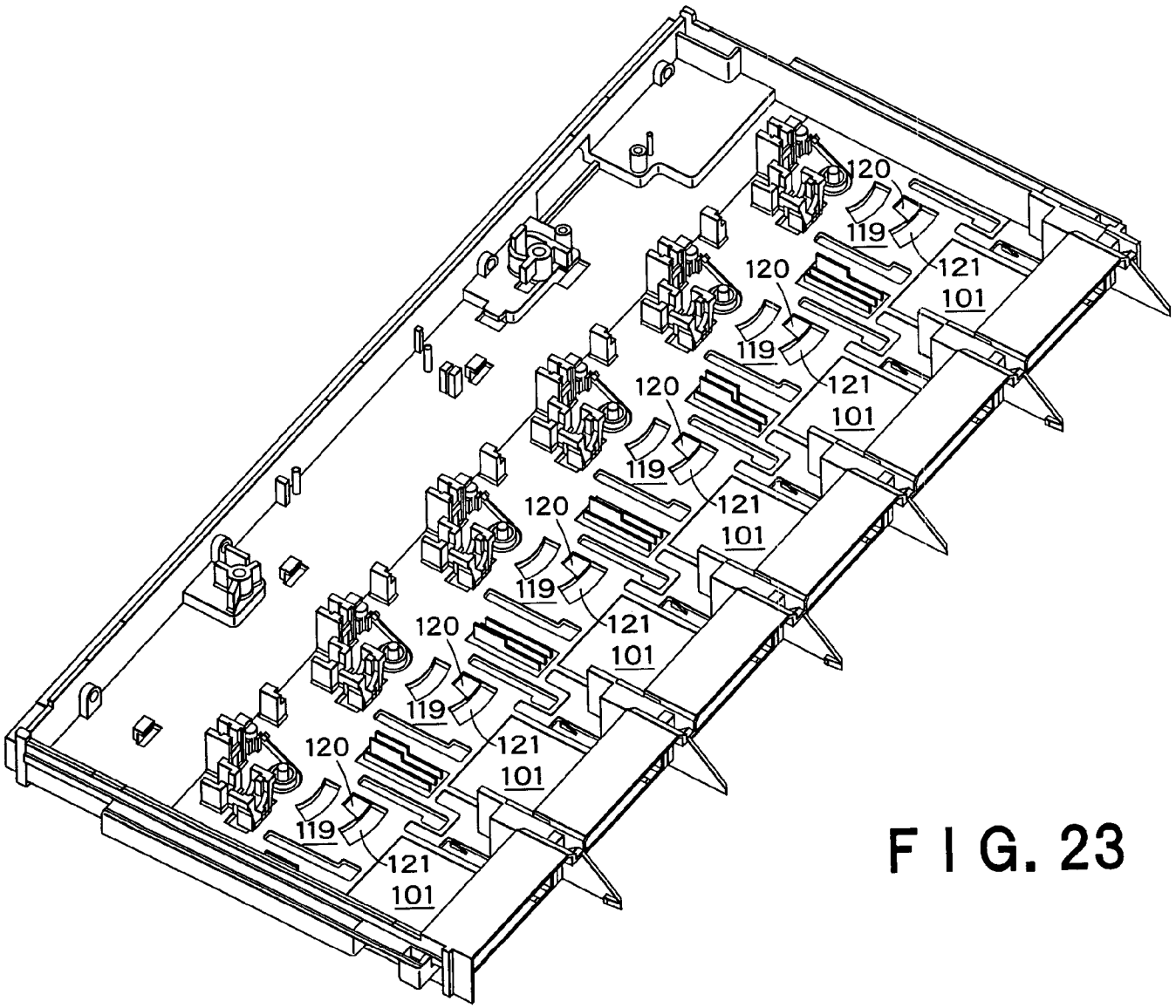
FIG. 23 is a perspective view showing a plurality of cartridge mounting units of the ink jet recording apparatus as an embodiment of the present invention from which the slider member, rotation lever member, and ink feed needle are removed.
Figure 24:
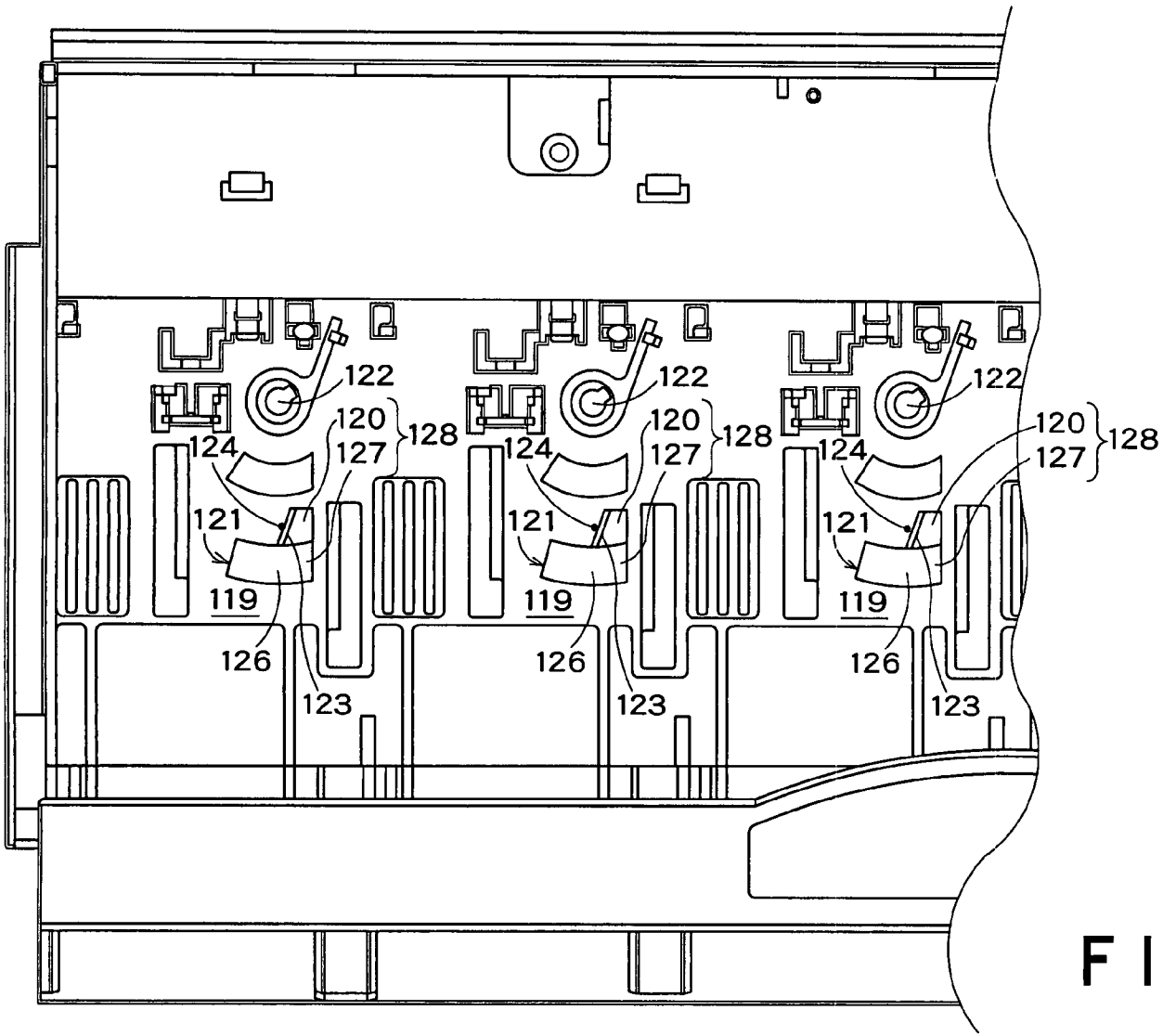
FIG. 24 is a plan view showing a part of the plurality of cartridge mounting units shown in FIG. 23.

As shown in FIGS. 23 and 24, on the support plate 119 for rotatably supporting the rotation lever member 108, at the part corresponding to the rotation range of the rotation lever member 108, a fan-shaped concavity 120 and a fan-shaped hole 121 formed continuously to it are formed. The fan-shaped hole 121 is positioned outside the fan-shaped concavity 120 in the radial direction for the rotation axial center 122 of the rotation lever member 108. Further, the fan-shaped hole 121 is formed in an angle range larger than the fan-shaped concavity 120 for the rotation axial center 122 of the rotation lever member 108. Further, in the fan-shaped hole 121 and the fan-shaped concavity 120, on one side of the rotational direction, the edges are matched with each other.

Further, in this embodiment, as shown in FIG. 23, structural members constituting a plurality of cartridge mounting units 101 are integrally formed and a cartridge mounting unit assembly is formed.

Figure 25:
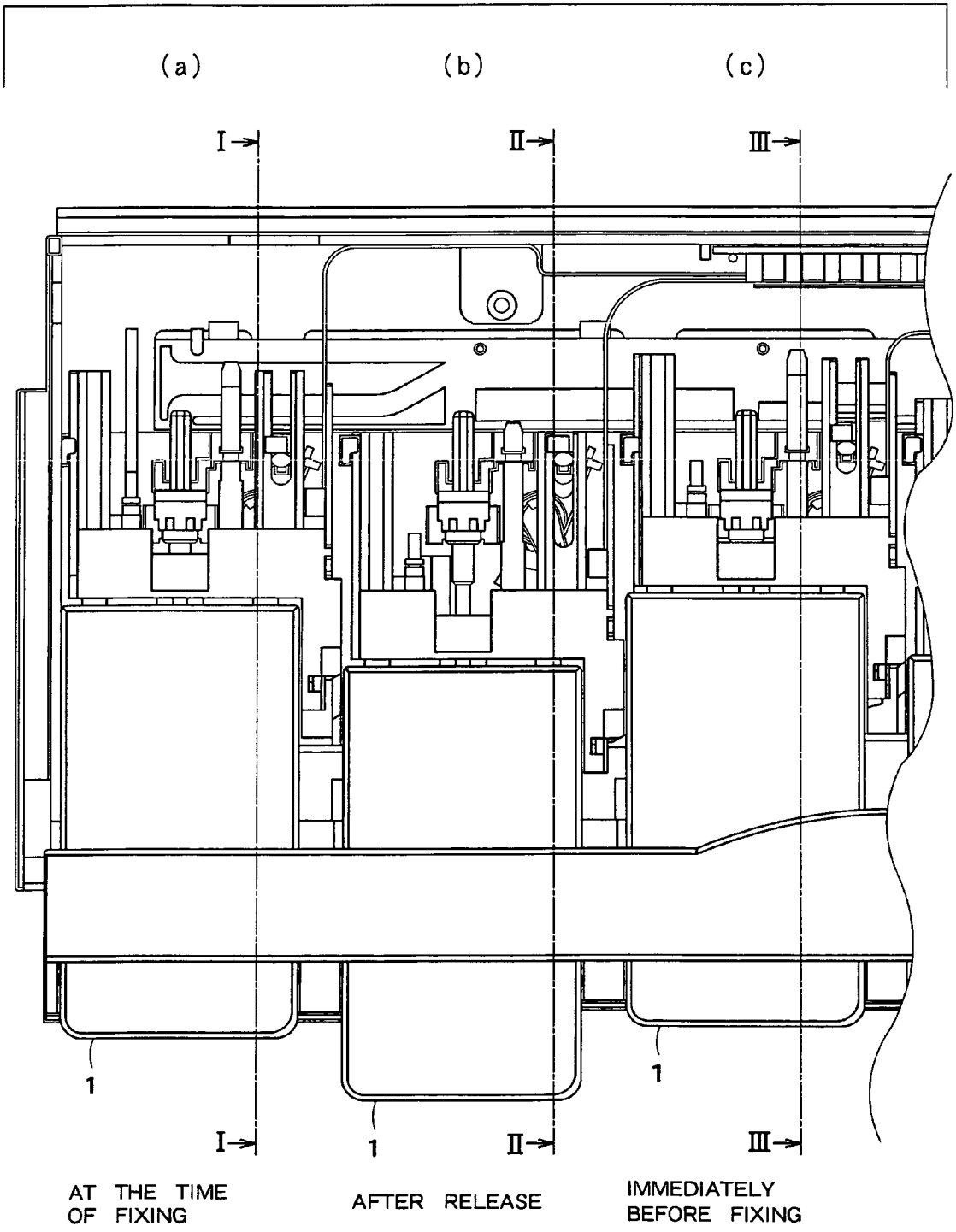
FIG. 25 is a plan view including (a), (b) and (c) respectively showing the fixing state of the ink cartridge to the cartridge mounting unit, the release state of the ink cartridge from the cartridge mounting unit, and the state immediately before fixing the ink cartridge to the cartridge mounting unit.

(a), (b) and (c) of FIG. 25 respectively show the fixing state of the ink cartridge 1 to the cartridge mounting unit 101, the state after the ink cartridge 1 is released from the cartridge mounting unit 101, and the state immediately before the ink cartridge 1 is fixed to the cartridge mounting unit 101. Further, (a), (b) and (c) of FIG. 26 are respectively drawings for explaining the positions of the rotation lever member 108 corresponding to (a), (b) and (c) of FIG. 25.

Figure 26:
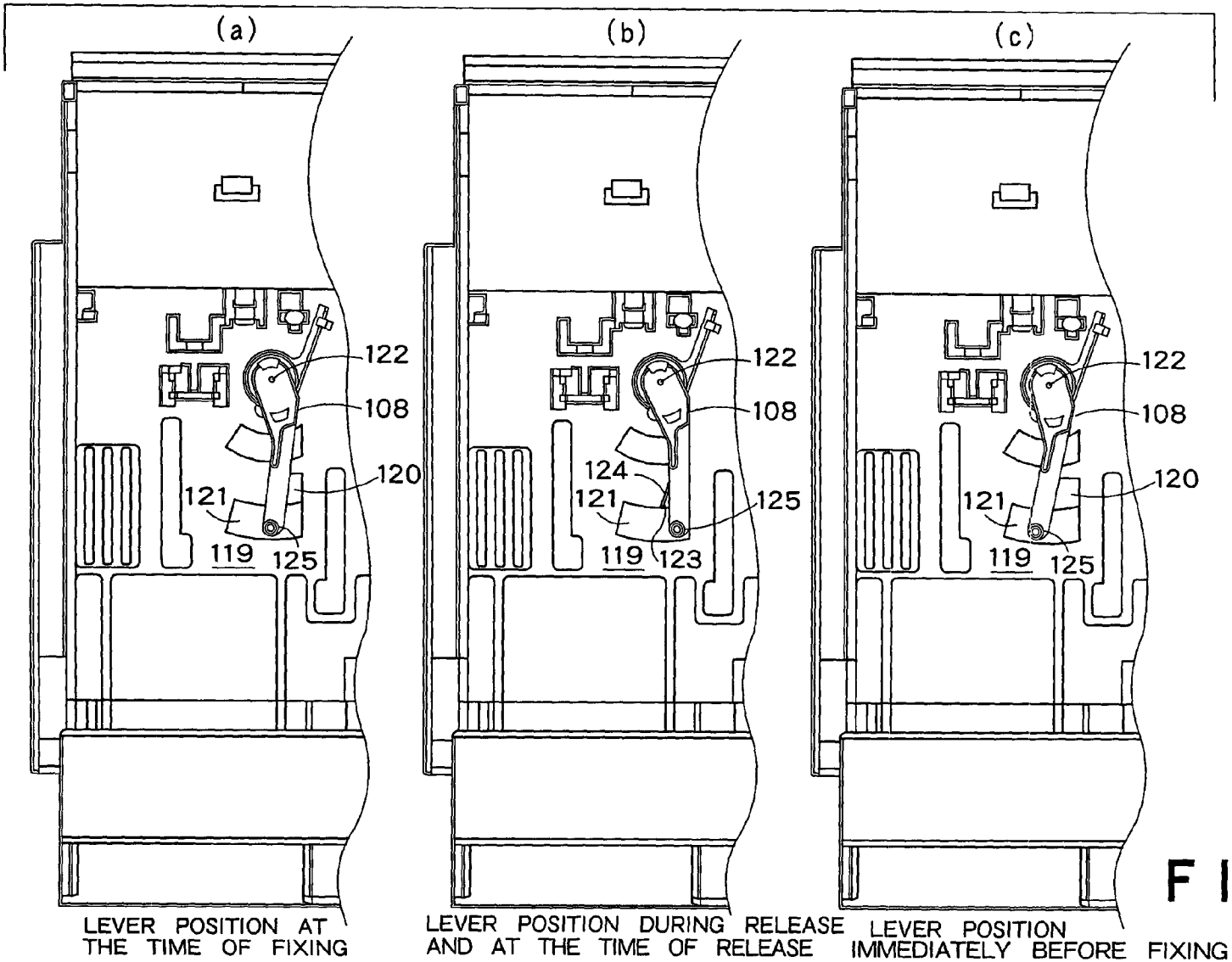
FIG. 26 is a plan view for explaining the positions of a rotation lever member 108, including (a), (b) and (c) corresponding to (a), (b) and (c) of FIG. 25.

As shown in FIG. 26(*a*), in the state (fixed state) that the ink cartridge 1 is mounted in the cartridge mounting unit 101, the rotation lever member 108 is arranged in the position facing to the edge 123 (FIG. 24) of the fan-shaped concavity 120 inside in the lever rotation direction. Namely, in this fixing state, a part of the rotation lever member 108 in the width direction is positioned above the fan-shaped concavity 121 and another one part thereof is positioned on the support plate 119.

And, in the fixed state of the ink cartridge 1, a part of the rotation lever member 108 in the width direction positioned on the support plate 119 is close to or in contact with the support plate 119. The support plate 119 partially close to or in contact with the rotation lever member 108 constitutes a displacement restriction part 124 for restricting the displacement of the rotation lever member 119 in the rotation axial center direction (vertical direction). The displacement restriction part 124 is close to or in contact with the rotation lever member 108 on the side of the rotation axial center 122 more than the lever end 125 where the stopper pin 112 of the rotation lever member 108 is formed.

Further, when the ink cartridge 1 is in the mounting state, on the part of the support plate 119 corresponding to the lever end 125 of the rotation lever member 108, a part of the aforementioned fan-shaped hole 121 is positioned and the part of the fan-shaped hole 121, when the ink cartridge 1 is forcibly pulled out, forms an emergency saving space 126 so that the lever end 125 of the rotation lever member 108 can displace downward.

Further, as shown in FIG. 26(*b*), when releasing the fixing of the ink cartridge 1 in the mounting state and taking out it, the rotation lever member 108 is positioned above the fan-shaped concavity 120 and the part 127 of the whole fan-shaped hole 121 corresponding to the fan-shaped concavity 120.

And, when taking out the ink cartridge 1, by the fan-shaped concavity 120 and the part 127 of the whole fan-shaped hole 121 corresponding to the fan-shaped concavity 120, a lever saving space 128 where the end part of the rotation lever member 108 displaced when the stopper pin 112 slides on the bottom of the guide groove 16 whose depth becomes gradually shallower enters is formed. The lever saving space 128 is formed by forming a concavity and a hole in the support plate 119, so that there is no need to increase the thickness of the cartridge mounting unit 101 in the vertical direction in correspondence to installation of the lever saving space 128 and an increase in the thickness of the ink jet recording apparatus 100 in the vertical direction can be prevented as well.

Figure 27:
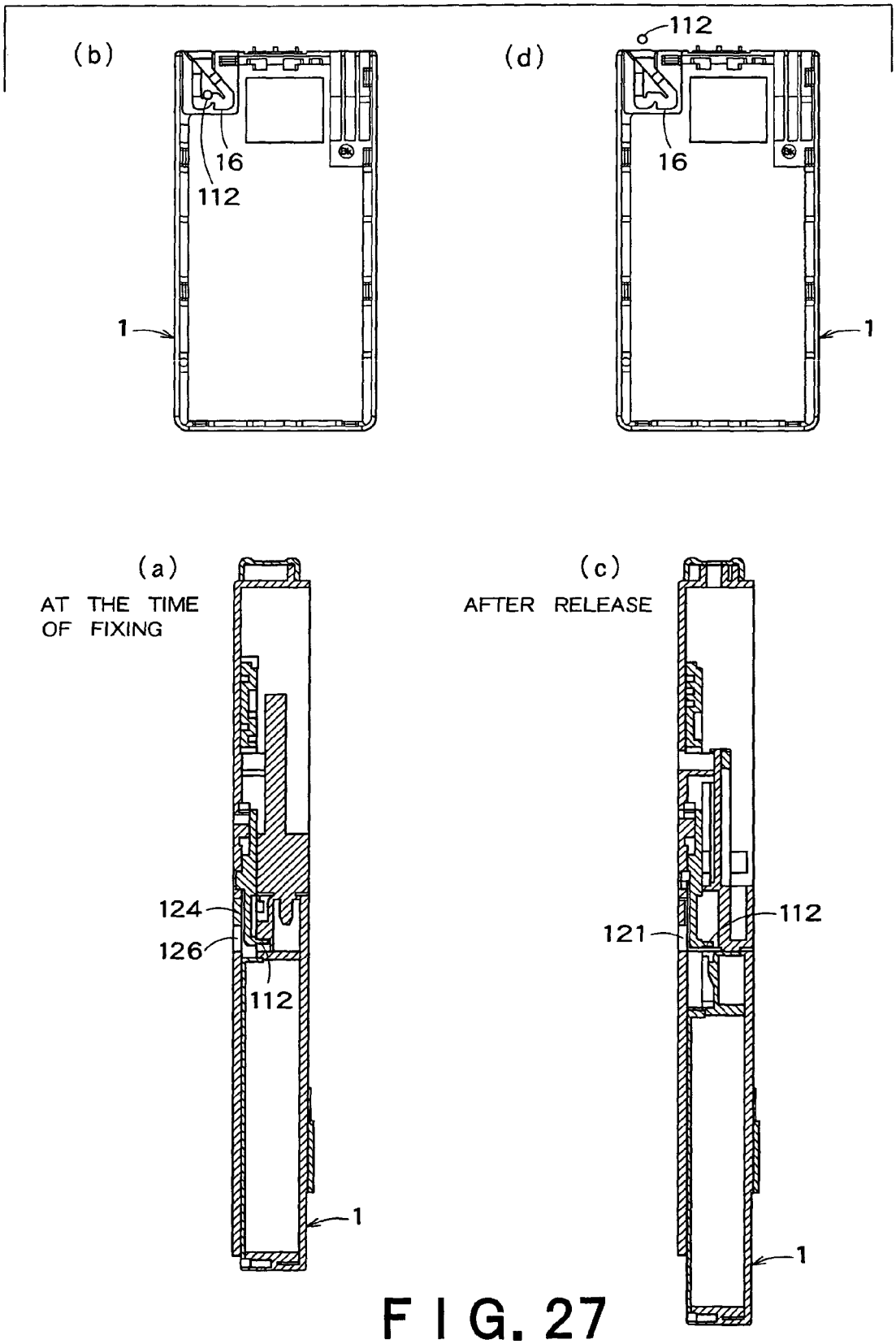
FIG. 27(*a*) is a sectional view along the line I-I in FIG. 25(*a*) showing the state when the ink cartridge is fixed, and FIG. 27(*b*) is a bottom view showing the bottom thereof together with the position of the stopper pin, and FIG. 27(*c*) is a sectional view along the line II-II in FIG. 25(*b*) showing the state after the ink cartridge is released, and FIG. 27(*d*) is a bottom view showing the bottom thereof together with the position of the stopper pin.

FIG. 27(*a*) is a sectional view of the line I-I in FIG. 25(*a*) showing the state when the ink cartridge is fixed, and FIG. 27(*b*) shows the bottom thereof together with the position of the stopper pin 112, and these drawings correspond to the position G shown in FIGS. 18 and 19.

FIG. 27(*c*) is a sectional view of the line II-II in FIG. 25 showing the state after the ink cartridge is released and FIG. 27(*d*) shows the bottom thereof together with the position of the stopper pin 112.

Figure 28:
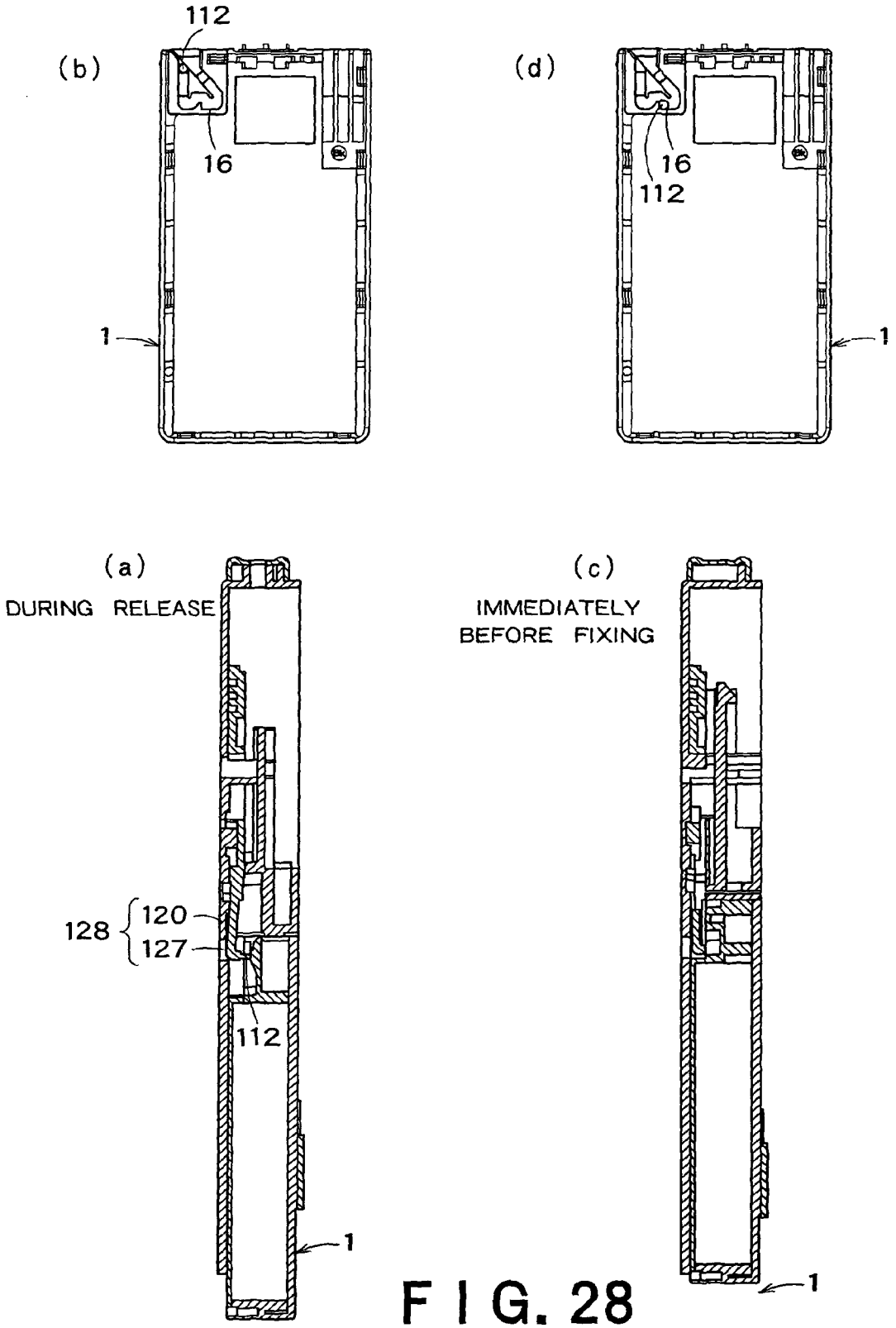
FIG. 28(*a*) is a vertical sectional view at the position of the stopper pin indicating the state under release of the ink cartridge, and FIG. 28(*b*) is a bottom view showing the bottom thereof together with the position of the stopper pin, and FIG. 28(*c*) is a sectional view along the line III-III in FIG. 25(*c*) showing the state immediately before fixing the ink cartridge, and FIG. 28(*d*) is a bottom view showing the bottom thereof together with the position of the stopper pin.

FIG. 28(*a*) is a vertical sectional view at the position of the stopper pin 112 showing the state during release of the ink cartridge 1, and FIG. 28(*b*) shows the bottom thereof together with the position of the stopper pin 112, and these drawings correspond to the position J shown in FIGS. 18 and 19.

FIG. 28(*c*) is a cross sectional view of the line III-III in FIG. 25(*c*) showing the state immediately before the ink cartridge 1 is fixed, and FIG. 28(*d*) shows the bottom thereof together with the position of the stopper pin 112, and these drawings correspond to the position F shown in FIGS. 18 and 19.

As shown in FIGS. 19 and 28(*a*), the position where the stopper pin 112 sliding on the bottom of the guide groove 16 is pressed down most is the position J of the ink cartridge 1 at the last stage of release thereof.

And, in this embodiment, when releasing the fixing of the ink cartridge 1 in the mounting state and taking out it, the rotation lever member 108 is positioned above the lever saving space 128 composed of the fan-shaped concavity 120 and the part 127 of the fan-shaped hole 121 corresponding to the fan-shaped concavity 120 (the state shown in FIG. 26(*b*)). Therefore, with respect to the rotation lever member 108 pressed down when the ink cartridge 1 is taken out, the end part thereof including the lever end 125 enters inside the lever saving space 128 and the pull-out operation of the ink cartridge 1 can be performed smoothly.

Further, in this embodiment, when the ink cartridge 1 is in the mounting state, the displacement of the rotation lever member 119 in the direction of the rotation axial center (vertical direction) is restricted by the displacement restriction unit 124 (the state shown in FIGS. 26(*a*) and 27(*a*)). Therefore, even when a shock is given to the ink cartridge 1, the rotation lever member 119 will not be displaced from the guide groove 16.

Furthermore, when the ink cartridge 1 is in the mounting state, only a part of the rotation lever member 119 in the width direction is close to or in contact with the displacement restriction unit 124, so that when the ink cartridge 1 is pressed in to release the fixing state, it is ensured that the stopper pin 112 at the position G shown in FIG. 18 moves to the position H smoothly and surely.

Further, in this embodiment, when the ink cartridge 1 is in the mounting state, the emergency saving space 126 is positioned under the lever end 125 (the state shown in FIGS. 26(*a*) and 27(*a*)). Therefore, even when the ink cartridge 1 in the mounting state is forcibly pulled out instead of by the general operation, by the flexibility of the rotation lever member 119, the lever end 125 enters the emergency saving space 126, thus the stopper pin 112 can be prevented from breaking.

As mentioned above, according to the ink jet recording apparatus 100 in this embodiment, the apparatus side positioning structure composed of the pair of positioning projections 103*a* and 103*b* and the pair of apparatus side positioning faces 104*a* and 104*b* is installed on the cartridge connection face of the slider member 102, so that the ink cartridge 1 can be connected to the slider member 102 with high positioning accuracy.

Further, the apparatus side contact 113 is arranged in the neighborhood of the positioning projection 103*a* and the apparatus side positioning face 104*a* which perform a higher accuracy positioning function, so that the electrode 8*a* of the storage device 8 of the ink cartridge 1 and the apparatus side contact 113 of the cartridge mounting unit 101 can be connected surely.

Further, the pressing force of the spring member 109 acts so as to press the electrode 8*a* of the storage device 8 toward the apparatus side contact 113 of the cartridge mounting unit 101 via the stopper pin 112 and the last stop side wall 18*a*, so that the connection of the electrode 8*a* of the storage device 8 to the apparatus side contact 113 can be made surer.

Further, according to the ink jet recording apparatus 100 in this embodiment, at the part of the slider member 102 through which the ink feed needle 106 is inserted, the ink absorption member 116 is installed, and when the slider member 102 is at the cartridge non-mounting position (initial position), the circumference of the ink flow hole 106*a* of the ink feed needle 106 is surrounded by the cylindrical ink absorption member 116, so that when the ink feed needle 106 is inserted through the ink feed port 3 of the ink cartridge 1 and when the ink feed needle 106 is pulled out from the ink feed port 3, ink leaking from the ink flow hole 106*a* at the end of the ink feed needle 106 can be received and absorbed by the ink absorption member 116, and even when the ink cartridge 1 is not mounted (FIG. 12A), ink leaking from the ink flow hole 106*a* of the ink feed needle 106 can be received and absorbed by the ink absorption member 116. Further, the ink absorption member 116 is opened on the face of the slider member 102 opposite to the ink cartridge 1, so that when the ink cartridge 1 is repeatedly mounted and demounted from the cartridge mounting unit 101, ink adhered and accumulated on the circumference of the ink feed port 3 can be absorbed.

Particularly, in the ink jet recording apparatus according to this embodiment, the motion of the ink absorption member 116 at the time of the insertion and pull-out operation of the ink cartridge 1 is a translational movement, so that when the ink cartridge 1 is to be pulled out, at the point of time when the ink feed needle 106 is perfectly pulled out from the ink feed port 3 of the ink cartridge 1, the circumference of the ink flow hole 106*a* of the ink feed needle 106 is already surrounded by the ink absorption member 116. Therefore, ink leaking from the ink flow hole 106*a* when pulling out the ink cartridge 1 can be surely received and absorbed by the ink absorption member 116.

Further, the slider member 102 in which the ink absorption member 116 is arranged is a member originally necessary to removably mount the ink cartridge 1 in the ink jet recording apparatus 100 and is not an exclusive member newly installed to ensure the mobility of the ink absorption member 116. As mentioned above, an exclusive member for ensuring the mobility of the ink absorption member 116 is not required, so that the problem of ink leakage can be appropriately settled without causing complication of the apparatus structure and enlargement of the apparatus.

Further, the ink absorption member 116 is arranged inside the slider member 102, so that there is no need to separately ensure an exclusive space for arranging the ink absorption member 116 and the ink absorption member 116 can be incorporated without causing enlargement of the apparatus.

Further, the ink cartridge 1 of this example can be mounted easily and surely in the cartridge mounting unit 101 of the ink jet recording apparatus 100.

Particularly, in the ink cartridge 1 of this example, the width of the entrance inclined face 22 formed at the entrance 16*a* of the guide groove 16 can be increased, so that the stopper pin 112 can be inserted surely into the guide groove 16. The rotation lever member 108 including the stopper pin 112, from the viewpoint of the function thereof, is designed so as to rotate in the direction Z perpendicular to the insertion and pull-out directions X and Y of the ink cartridge 1, so that there is the possibility that the initial position (the position when the ink cartridge is not mounted) of the stopper pin 112 may be varied. However, when the width of the entrance inclined face 22 is set wide, such variations can be permitted.

Further, in the ink cartridge 1 of this example, only by one operation (one push operation) of inserting the ink cartridges into the cartridge mounting unit 101, the mounting operation can be completed, while when removing the ink cartridge 1 from the cartridge mounting unit 101, only by a simple operation of slightly pressing in the ink cartridge 1, the fixing state of the ink cartridge 1 can be released. As mentioned above, in this embodiment, the mounting and demounting operation of the ink cartridge 1 can be performed very easily.

Further, in the ink cartridge 1 of this example, the guide groove 16 is formed on the bottom of the concavity 17 formed on the surface of the cartridge, so that when the stopper pin 112 is inserted in the guide groove 16, the projection amount of the rotation lever member 108 from the cartridge surface can be made smaller or reduced to zero. Therefore, the thickness of the cartridge mounting unit 101 can be made smaller and the whole ink jet recording apparatus 100 can be made thinner as well. Particularly, in a case of an apparatus of a type that a plurality of ink cartridges 1 are flatwise placed side by side like the ink jet recording apparatus 100 shown in FIG. 1, the thinness of the whole apparatus is important, so that the ink cartridge 1 of this embodiment in which the thickness of the cartridge mounting unit 101 can be made smaller is very effective.

Further, according to the ink jet recording apparatus 100 having the cartridge mounting unit 101 of this embodiment, the part of the electric cable 118 other than the conductive end 123 is fixed to the substrate extended part 125 fixed to the slider member 102, so that during the back and forth operation of the slider member 102, the electric cable 118 can be prevented from disconnecting from the connector 124.

Further, according to this embodiment, the substrate extended part 125 for fixing the electric cable 118 is formed integrally with the contact substrate 120, and the electric cable 118 and the substrate extended part 125 are fixed by the double-coated tape 126, so that there is no need to ensure a large space for the fixing structure of the electric cable 118, and the conductive end 123 of the electric cable 118 is connected to the connector 124, and then the electric cable 118 can be fixed to the substrate extended part 125 by a simple operation.

Further, according to this embodiment, the substrate extended part 125 for fixing the electric cable 118 is extended in the insertion direction of the ink cartridge 1, so that the displacable range of the electric cable 118 is restricted by the substrate extended part 125, thus the electric cable 118 displaced during the back and forth operation of the slider member 102 can be prevented from being caught by the surrounding members.

Further, according to this embodiment, without increasing the thickness of the ink jet recording apparatus 100 in the vertical direction and without adding new parts, the smooth operation of the rotation lever member 119 can be ensured, and the fixing of the ink cartridge 1 in the mounting state can be prevented from being released by mistake, and even when the ink cartridge 1 in the mounting state is unreasonably pulled out by a user, the stopper pin 112 of the rotation lever member 119 can be prevented from breaking.

Figure 29:
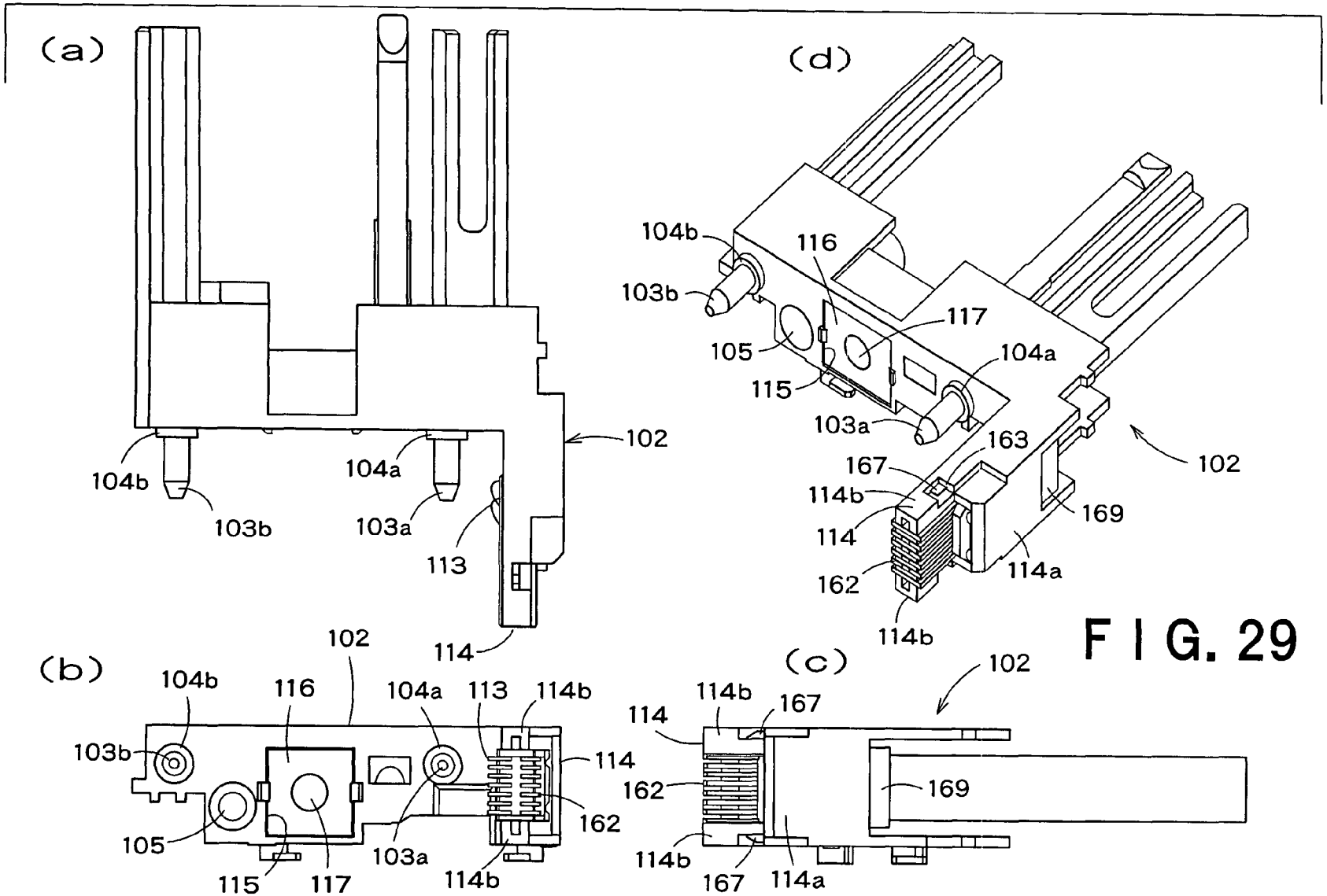
FIG. 29 is a drawing showing a slider member of the cartridge mounting unit of the ink jet recording apparatus of another embodiment of the present invention, and FIG. 29(*a*) is a plan view, and FIG. 29(*b*) is a front view, and FIG. 29(*c*) is a side view, and FIG. 29(*d*) is a perspective view.

Next, another embodiment of the present invention will be explained by referring to FIGS. 29 and 30.

In this embodiment, on the contact projection 114 projected at one end of the front of the slider member 102, a contact attachment 162 formed separately from the contact projection 114 is mounted. On the contact attachment 162, the apparatus side contact 113, which is configured to be connected to the electrode 8*a* of the storage device 8 of the ink cartridge 1, is installed.

The contact projection 114 has a cylindrical part 114*a* having an almost four-sided section which is formed integrally with the slider member 102 and a pair of upper and lower projecting portions which are formed integrally with the cylindrical part 114*a* at the inner front end of the cylindrical part 114*a*. The area held between the pair of projecting portions 114*b* is opposite to the electrode 8*a* of the storage device 8 of the ink cartridge 1 mounted in the slider member 102. On each projecting portion 114*b*, a locking notch 163 for releasably fixing the contact attachment 162 is formed.

Figure 30:
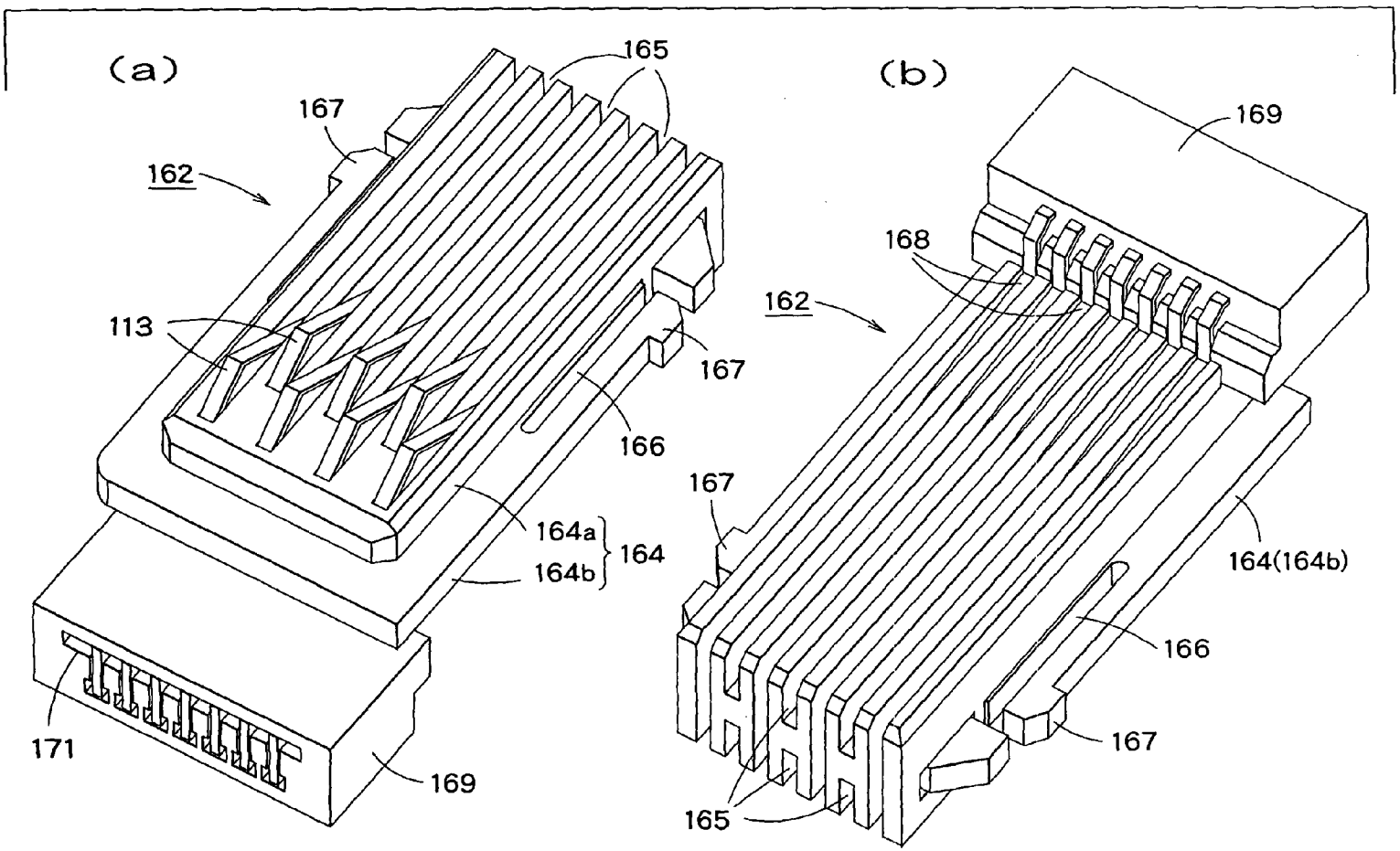
FIG. 30 is a perspective view showing an enlarged contact attachment mounted in the slider member shown in FIG. 29, and FIG. 30(*a*) shows the inner face side, and FIG. 30(*b*) shows the outer face side.

As shown in FIG. 30, the contact attachment 162 has a base portion 164 formed by overlaying a narrow first base plate 164*a* and a wider second base plate 164*b*. On the inner face and outer face of the base portion 164, a plurality of longitudinal slits 165 are formed. At the right and left edges of the front end of the second base plate 164*b*, a pair of longitudinal slits 166 are formed. In the areas outside the slits 166, locking projections 167 whose front ends are formed in an almost arrowhead shape are formed.

Inside the slits 165 formed on the inner face and outer face of the base portion 164, a plurality of conductive pieces 168 of a thin metallic band plate shape which are arranged and supported in a continuous state are arranged. As shown in FIG. 30(*a*), the front ends of the conductive pieces 168 arranged in the slits 165 of the inner face of the base portion 164 are bent and projected to form the apparatus side contacts 113.

At the rear end of the second base plate 164*b*, a connector 169 is installed and the contact of the connector 169 is conducted to the conductive pieces 168.

The interval between the locking projections 167 installed on both sides of the base portion 164 is set slightly larger than the longitudinal size of the hollow part of the cylindrical part 114*a* of the contact projection 114. Therefore, when the base portion 164 is inserted into the contact projection 114 up to a predetermined position, the locking projections 167 are locked by the locking notches 163.

When attaching the contact attachment 162 having such a constitution to the contact projection 114 of the slider member 102, the second base plate 164*b* to which the connector 169 is attached is directed outward, and the first base plate 164*a* on which the apparatus side contacts 113 are installed is directed inward, and then the contact attachment 162 is inserted through the opening at the rear end of the cylindrical part 114*a* of the contact projection 114. When the inclined sides of the locking projections 167 of the contact attachment 162 touch the opening at the rear end of the cylindrical part 114*a* of the contact projection 114, both locking projections 167 and 167 move inward to narrow the interval thereof, so that the contact attachment 162 can be inserted more.

And, when the contact attachment 162 is sufficiently inserted up to the predetermined position, the locking projections 167 of the contact attachment 162 are locked by the locking notches 163 of the contact projection 114, thus the contact attachment 162 is fixed at the predetermined position of the slider member 102. Simultaneously at this time, the apparatus side contact 113 is projected on the face in the insertion direction of the ink cartridge 1 and is arranged at the position opposite to the contact 8*a* of the storage device 8 of the ink cartridge 1.

After the contact attachment 162 is mounted on the contact projection 114 of the slider member 102 in this way, one end of the electric cable 118, such as a flexible cable, of which the other end is conducted to the circuit substrate of the controller of the ink jet recording apparatus 100, is inserted into an elongated connection hole 171 of the connector 169. By doing this, the electric cable 118 is electrically connected to the conductive pieces 168, thereby, the controller of the ink jet recording apparatus 100 is conducted with the apparatus side contacts 113 of the contact attachment 162.

As mentioned above, in this embodiment, the contact attachment 162 can be simply attached to the slider member 102 of the cartridge mounting unit 101 and moreover the attaching procedure is not restricted, so that the assembling operation can be performed very easily. Further, when any failure is discovered after being assembled, it can be reassembled simply. Further, the other end of the electric cable 118 is connected to the conductive pieces 168 of the contact attachment 162, so that the apparatus side contact 113 approaches the connection of the signal wire and an enough space is obtained, thereby, the degree of freedom of layout of the signal wire is increased.

Further, in this embodiment, the end of the electric cable 118 is inserted into the connection hole 171 of the connector 169 to be connected with the conductive pieces 168. However, as a modification, the connector 169 may be omitted, and a terminal conducted to the conductive piece 168 is installed on the contact attachment 162, and the electric cable 118 may be directly soldered to the terminal. Or, the end of the conductive piece 168 may function as a terminal and the electric cable 118 may be directly soldered to the end of the conductive piece 168.

Figure 31:
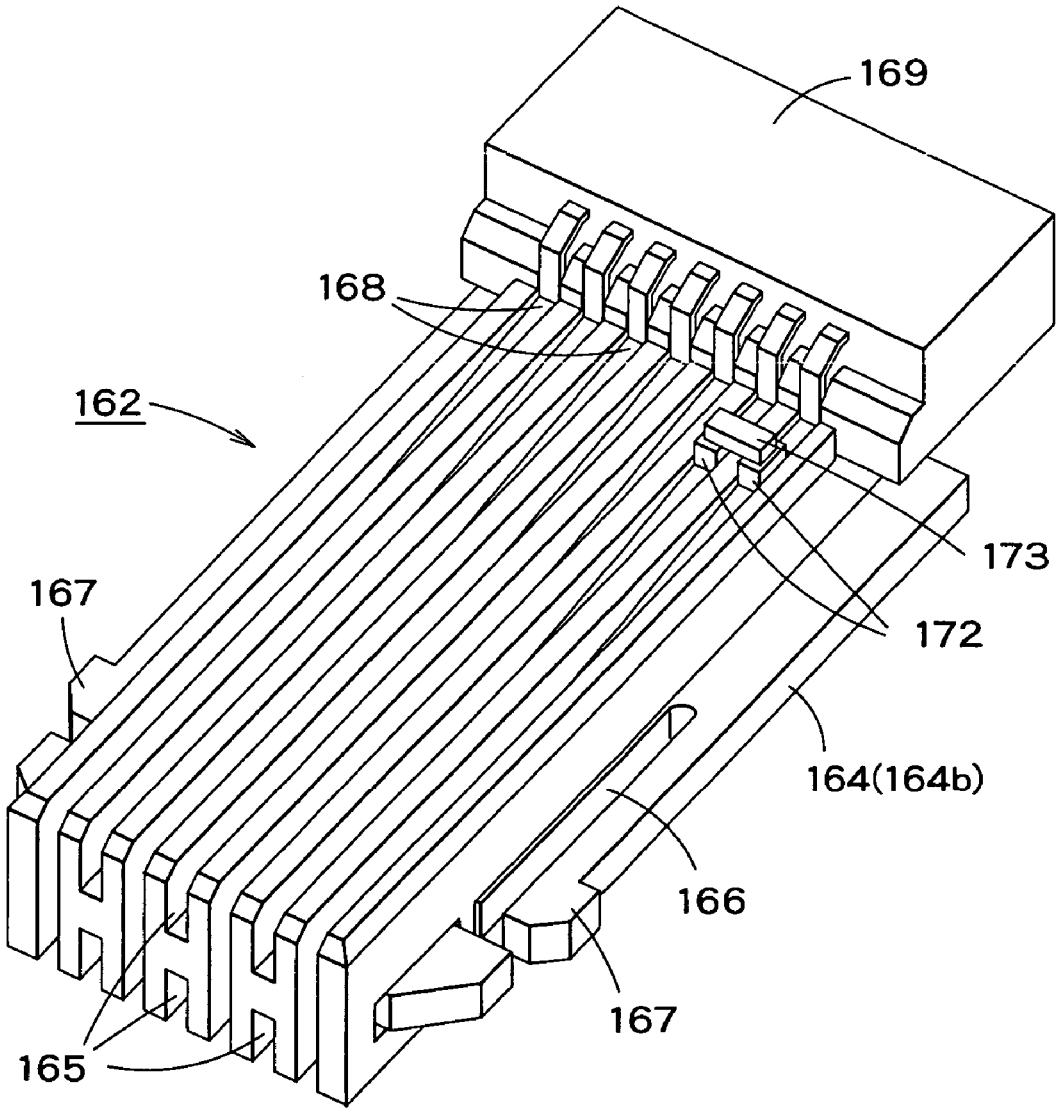
FIG. 31 is a perspective view showing a contact attachment as a modification of the embodiment shown in FIGS. 29 and 30.

Furthermore, as another modification, an electronic element for adjusting an electric signal can be mounted on the contact attachment 162. Concretely, as shown in FIG. 31, at least one pair of electrical connections 172 is installed on the parts of the conductive pieces 168 on the side of the connector 169, and on the electrical connections 172 and 172, a capacitor 173 is mounted as the electronic element. Here, the "electronic element for adjusting an electric signal" means an electronic element for stabilizing the voltage of an electric signal and removing noise.

When the capacitor 173 is mounted on the contact attachment 162, electric signals received or transmitted between the storage device 8 of the ink cartridge 1 and the controller of the ink jet recording apparatus 100 via the contact attachment 162 can be stabilized.

When the electronic element is mounted on the contact attachment 162 like this, the structure necessary to mount the electronic element can be simplified.

Further, in FIG. 31, an example that the capacitor 173 is mounted on the contact attachment 162 is shown. However, the present invention is not limited to it and electronic elements other than the capacitor 173 can be mounted.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A liquid ejecting apparatus having a container mounting unit in which a liquid container internally storing a liquid is to be mounted removably, comprising:

a liquid feed needle configured to be inserted through a liquid feed port formed in the liquid container when the liquid container is mounted;

a translationally movable member configured to be connected to the liquid container inserted in said container mounting unit and in link motion with a straight movement of the liquid container when inserting said liquid feed needle through the liquid feed port, so as to translationally advance toward the liquid feed needle in a direction parallel with said straight movement;

an apparatus side fixing structure configured to releasably restrict a movement of the liquid container in a mounting state in a pull-out direction, said apparatus side fixing structure having a stopper pin to be stopped in a guide groove of a container side fixing structure formed in the liquid container; and an apparatus side positioning structure installed in said translationally movable member, the apparatus side positioning structure and translationally movable member constructed and arranged to position the liquid container in a predetermined position with respect to said translationally movable member in cooperation with a container side positioning structure formed in the liquid container, before said liquid feed needle is inserted through the liquid feed port when the liquid container is mounted on the liquid ejecting apparatus;

wherein the apparatus is constructed so that the direction of the straight movement of the liquid container is opposite to the pull-out direction of the liquid container and the direction in which the liquid container is inserted into the container mounting unit is parallel to the direction of the straight movement.

2. A liquid ejecting apparatus according to claim 1, wherein an apparatus side contact configured to be connected to an electrode of a storage device installed in the liquid container for storing information on the liquid in the liquid container is installed on said translationally movable member.

3. A liquid ejecting apparatus according to claim 2, wherein said apparatus side contact is arranged near said apparatus side positioning structure.

4. A liquid ejecting apparatus having a container mounting unit in which a liquid container internally storing a liquid is to be mounted removably, comprising:

a liquid feed needle configured to be inserted through a liquid feed port formed in the liquid container when the liquid container is mounted;

a translationally movable member configured to be connected to the liquid container inserted in said container mounting unit and in link motion with a straight movement of the liquid container when inserting said liquid feed needle through the liquid feed port, so as to translationally advance toward the liquid feed needle in a direction parallel with said straight movement;

an apparatus side fixing structure configured to releasably restrict a movement of the liquid container in a mounting state in a pull-out direction, said apparatus side fixing structure having a stopper pin to be stopped in a guide groove of a container side fixing structure formed in the liquid container; and an apparatus side positioning structure installed in said translationally movable member for positioning the liquid container in a predetermined position with respect to said translationally movable member in cooperation with a container side positioning structure formed in the liquid container, wherein an apparatus side contact configured to be connected to an electrode of a storage device installed in the liquid container for storing information on the liquid in the liquid container is installed on said translationally movable member, and, wherein said stopper pin is pressed so as to press the electrode of the storage device of the liquid container in said mounting state toward said apparatus side contact.

5. A liquid ejecting apparatus having a container mounting unit in which a liquid container internally storing a liquid is to be mounted removably, comprising:

a liquid feed needle configured to be inserted through a liquid feed port formed in the liquid container when the liquid container is mounted;

a translationally movable member configured to be connected to the liquid container inserted in said container mounting unit and in link motion with a straight movement of the liquid container when inserting said liquid feed needle through the liquid feed port, so as to translationally advance toward the liquid feed needle in a direction parallel with said straight movement;

an apparatus side fixing structure configured to releasably restrict a movement of the liquid container in a mounting state in a pull-out direction, said apparatus side fixing structure having a stopper pin to be stopped in a guide groove of a container side fixing structure formed in the liquid container; and an apparatus side positioning structure installed in said translationally movable member for positioning the liquid container in a predetermined position with respect to said translationally movable member in cooperation with a container side positioning structure formed in the liquid container;

wherein said apparatus side positioning structure has a positioning projection configured to be inserted in a positioning hole of the container side positioning structure.

6. A liquid ejecting apparatus according to claim 5, wherein said positioning hole and said container side fixing structure are arranged so that said positioning projection inserted in said positioning hole and said container side fixing structure are overlaid in a direction of thickness of the liquid container.

7. A liquid ejecting apparatus according to claim 1, wherein said apparatus side positioning structure includes an apparatus side positioning face for positioning the liquid container in an insertion direction thereof and said apparatus side positioning face makes contact with a container side positioning face formed in the container side positioning structure.

8. A liquid ejecting apparatus according to claim 1, wherein:

said liquid ejection apparatus is an ink jet recording apparatus, and the liquid container is an ink cartridge adapted to be removably mounted in said ink jet recording apparatus.

* * * * *